US010706671B2

(12) United States Patent
Humphrey

(10) Patent No.: US 10,706,671 B2
(45) Date of Patent: Jul. 7, 2020

(54) EXTENSION GAMING AND SERVICES FOR MOBILE DEVICES IN A GAMING ENVIRONMENT

(71) Applicant: IGT, Las Vegas, NV (US)

(72) Inventor: Thomas Humphrey, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/848,949

(22) Filed: Dec. 20, 2017

(65) Prior Publication Data

US 2019/0188943 A1 Jun. 20, 2019

(51) Int. Cl.
*G07F 17/12* (2006.01)
*G07F 17/32* (2006.01)

(52) U.S. Cl.
CPC ..... *G07F 17/323* (2013.01); *G07F 17/3223* (2013.01); *G07F 17/3262* (2013.01); *G07F 17/3272* (2013.01); *G07F 17/3288* (2013.01); *G07F 17/3293* (2013.01)

(58) Field of Classification Search
None
See application file for complete search history.

(56) References Cited

U.S. PATENT DOCUMENTS

2011/0212767 A1* 9/2011 Barclay ..... G07F 17/32 463/25
2014/0128138 A1* 5/2014 Wickett ..... G07F 17/3237 463/13
2014/0141864 A1* 5/2014 Ward ..... G07F 17/34 463/25
2016/0140807 A1* 5/2016 Chase ..... G07F 17/3255 463/25
2018/0225912 A1* 8/2018 Katz ..... G07F 17/32

* cited by examiner

*Primary Examiner* — Damon J Pierce
(74) *Attorney, Agent, or Firm* — Sheridan Ross P.C.

(57) ABSTRACT

A player is enabled to initiate on a mobile device a multiplayer game via a community gaming panel for multiplayer game play. Additional players are enabled to access the multiplayer game on additional mobile devices to enroll in the multiplayer game. The multiplayer game is funded by wagers from the player, additional players, a gaming venue, or a third party funding source. An outcome is determined for the multiplayer game based on one or more plays of the multiplayer game by the player and/or the additional players. The mobile device and the additional mobile devices are remotely connected to a server associated with multiple gaming machines. The player and the additional authenticated players are each associated with a respective gaming machine.

23 Claims, 8 Drawing Sheets

EXTENSION GAMING AND SERVICES FOR MOBILE DEVICES IN A GAMING ENVIRONMENT

BACKGROUND

The present disclosure relates in general to gaming devices and systems, and more particularly to extending gaming and services to a smartphone of a carded player in a gaming system.

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs include specially programmed computers and contain multiple external interfaces. Further, the EGMs may communicate with mobile devices to provide the gaming functionality programmed therein in a portable fashion.

BRIEF SUMMARY

Various embodiments for extending gaming and services to a smartphone of an authenticated player for one or more electronic gaming machines (EGMs) in a gaming system by a processor are provided. A first authenticated player may be enabled to initiate on a first mobile device a multiplayer game via a community gaming panel for multiplayer game play. One or more additional authenticated players may be enabled to access the multiplayer game on one or more additional mobile devices to enroll in the multiplayer game. The multiplayer game may be funded by one or more wagers by the first authenticated player, the one or more additional authenticated players, a gamine venue, and/or a third party funding source (e.g., the players, a financial institution, an organization, a provider of services, entertainment entities, a business entity, and the like). An outcome may be determined for the multiplayer game based at least in part on one or more plays of the multiplayer game by the first player and the one or more additional authenticated players. The first mobile device and the one or more additional mobile devices may be remotely connected to a server associated with a plurality of electronic gaming machines (EGMs). The first authenticated player and the one or more additional authenticated players are each associated with a respective one of the plurality of EGMs.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict embodiments of the disclosure and are not therefore to be considered to be limiting of its scope, the disclosure will be described and explained with additional specificity and detail through the use of the accompanying drawings, in which.

DETAILED DESCRIPTION

Figure 1:
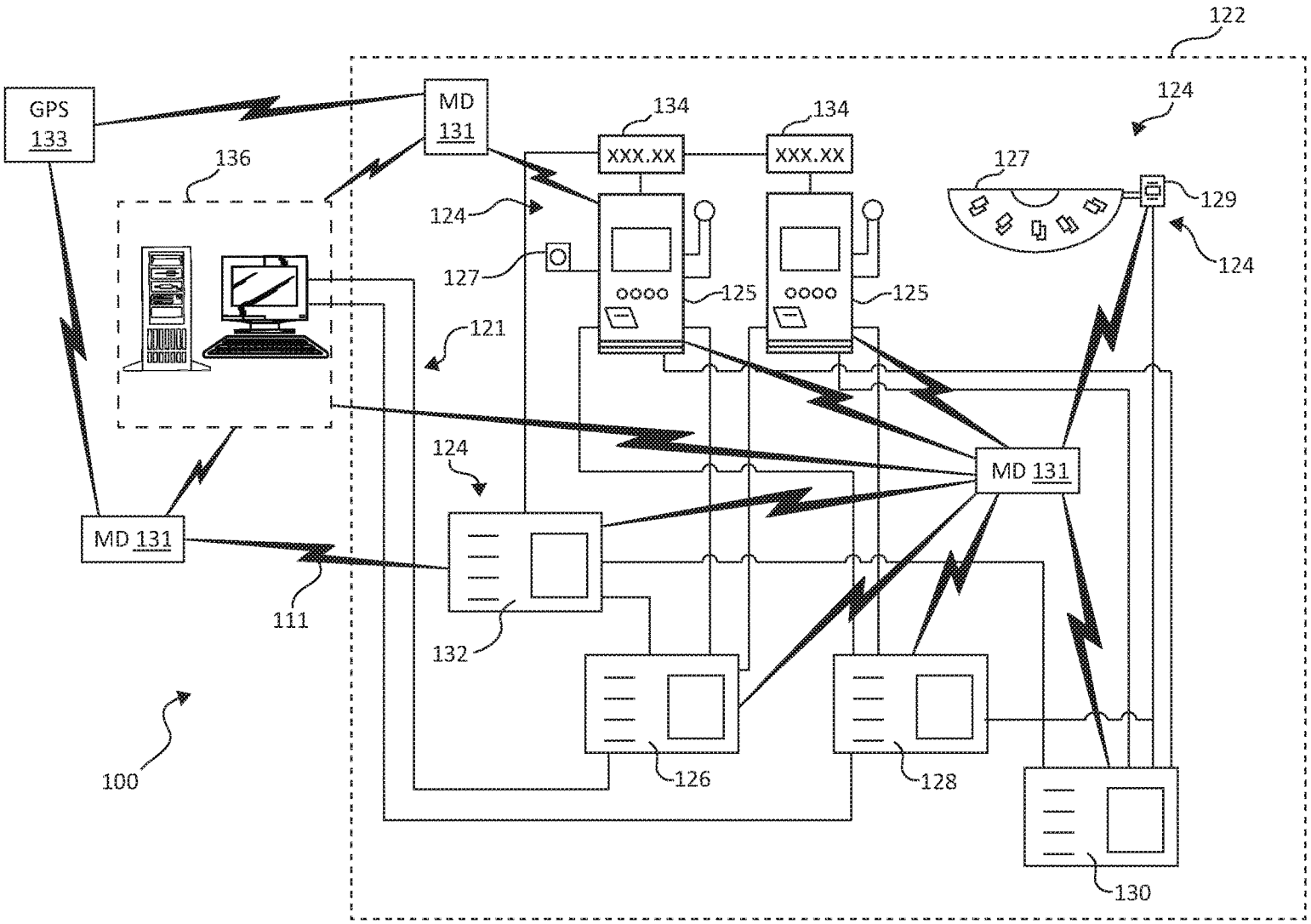
FIG. 1 is a block diagram illustrating a gaming system environment with a gaming terminal data repository (GTDR) connected via one or more network interface(s) to a gaming network which, for example, may include gaming devices (e.g., gaming terminals)

In general, gaming machines, such as electronic gaming machines (EGMs), require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming machine, such as one providing a slot game, may allow players to make wagers of substantially different amounts on each play of the primary or base game ranging, for example, from one credit up to 125 credits (e.g., five credits on each of 25 separate pay lines). This principle holds true for other wagering games, such as video draw poker, where players may wager one or more credits on each hand and where multiple hands may be played simultaneously. Of course, different players play at substantially different wagering amounts or levels and at substantially different rates of play. This purely exemplary functionality and a variety of other gaming functionality may be employed on EGMs such that a player physically sits at the EGM to initiate game play, or this functionality may be extended to mobile electronic devices such as smartphones and tablets for a more portable experience.

A current challenge for gaming institutions is providing EGMs that store gaming programs for operating and using the EGM, while additionally implementing by the EGMs a variety of applications that provide functionality such as, for example, applications and systems for transferring money, and programs that facilitate player interaction on a social media platform. As the gaming industry becomes increasingly mobile, it is likely that players will be using their various external devices (e.g., mobile devices such as cell phones and the like) in casinos and other gaming venues to initiate game play, while desiring to gain quicker access to winnings (through the external devices) from the various games the player has played. Moreover, there are many use cases for those other than players (e.g., regulators, and/or operators) to use external applications provided through such external devices for auditing, bookkeeping, game and program updating services and the like, in the gaming venue environment.

Furthermore, gaming has increasingly become more of a social activity. Players often enjoy playing games in which the players compete against one another or work together toward a common goal. Accordingly, gaming establishments strive for ways to enable players to play games with other players either competitively or cooperatively to enhance the players' gaming experiences. A continuing need thus exists for gaming systems and methods that provide new, exciting, and engaging multiplayer or community games for enhancing social activities within the gaming environment.

The functionality presented in the instant disclosure provides advances to the gaming art by describing various embodiments for extending gaming and services to a smartphone of an authenticated player for one or more EGMs in a gaming system. A first authenticated player may be enabled to initiate on a first mobile device a multiplayer game via a community gaming panel for multiplayer game play. A second authenticated player may be enabled to access the multiplayer game on a second mobile device to enroll in the multiplayer game created by the first authenticated player initiated on the first mobile device. An outcome may be determined for the multiplayer game based at least in part on one or more plays of the multiplayer game by the first player, the second player, or combination thereof. The first mobile device and the second mobile device are remotely connected to a server associated with a plurality of the EGMs, and the first authenticated player and the second authenticated player are each associated with a respective one of the plurality of EGMs. In one aspect, one or more winnings, awards, loyalty points, prizes, rewards, services, or a combination thereof may be provided for each determined outcome for the multiplayer game, where the determined outcome is a game win of the multiplayer game.

In one embodiment, the gaming system of the present disclosure includes a server and a plurality of devices (such as the EGMs and/or personal mobile devices (PMDs)) that are configured to communicate with the server. In operation of this embodiment, the gaming system generally: (a) enables players of the devices to play individual primary games independent of one another; (b) enables each of the players to enroll in a multiplayer game via a community panel; and (c) when a designated number of players (such as a maximum number of players or at least a minimum number of players) have enrolled in the multiplayer game, provides the multiplayer game via the community panel to an EGM and the player's associated PMD by a designated one of the players of the multiplayer game. This is performed independent of any play of any primary games of the other players of the multiplayer game.

That is, the gaming system enables players to create multiplayer games via a community gaming panel, such as by selecting this option through one or more characteristics within the multiplayer game. In certain such embodiments, when providing a player-created multiplayer game, the gaming system designates the player who created the multiplayer game as the designated player whose community multiplayer game (through the use of the player's PMD in association with a particular EGM) controls play of the multiplayer game. In other words, in these embodiments, when a player creates a multiplayer game, the gaming system may determine the outcome of the multiplayer game based on play of the multiplayer game of that particular player.

More specifically, in operation of one such embodiment, the server may receive, from a first device, a create multiplayer game input from a first player of the first device (a first EGM or PMD). The server may also receive, from the first device, one or more multiplayer game attribute selections selected by the first player of the first device. The server then creates a multiplayer game based at least in part on the received one or more multiplayer game attribute selections. The server may enroll the first player in the multiplayer game, and enable players of other devices (e.g., having PMDs in communication with alternative EGMs) to enroll in the multiplayer game via the community gaming panel. Once a designated number of players (such as a maximum number of players or at least a minimum number of players) have enrolled in the multiplayer game, the server initiates (begins) the multiplayer game. The server determines an outcome of the multiplayer game based at least in part on play of each of one or more plays of the first player and/or play of other players of the multiplayer game. The server may determine any multiplayer game awards based on the multiplayer game outcomes, and may cause the given device of at least one of the players of the multiplayer game to display any determined multiplayer game awards.

It should be appreciated that while certain components of the gaming system are described below as performing certain functions, in other embodiments, any other suitable components of the gaming system may perform such functions alone or in combination with one or more other components. In one aspect, the EGMs enable their respective players to play individual primary games, and/or the multiplayer game via a PMD. Alternatively, a server coordinates, maintains, and provides the multiplayer games via the community gaming panel on an EGM, a PMD, or combination thereof.

As used herein, the community game panel or "community gaming panel" may be provided within a digital side panel overlay on an EGM's display (e.g., an interactive graphical user interface (GUI)) that may be accessed, for example, by pressing an on-screen button on the EGM's display or some other implemented feature of the EGM. The community gaming panel houses (displays) each of the multiplayer games available for play. The EGM may also provide PMD (e.g., smartphone, laptop computer, personal computer, tablet, hand-held computing device, or other computing device) access to the community gaming panel. Alternatively, the EGM may enable the PMD to download a community gaming panel application onto the PMD so as to enable the PMD to access, create, and play one or more community games/multiplayer games provided via the community gaming panel associated with the particular EGM.

The community gaming panel overlay may comprise a menu that offers one or more different community games and options. The community game panel may additionally and/or alternatively be accessed via voice or audio detection (e.g., when a player issues a voice-activated command such as "EGM, open the community panel game"), biometric data (e.g., retinal scan, fingerprint, etc.), or some combination thereof. Executing the access operation such as, for example, by pressing the on-screen button or via a voice command, causes an overlay-menu to appear that displays multiplayer games. A player may then select different multiplayer games to participate in. This allows the player to take part in community style wagering while playing a stand-alone game. In one aspect, the community gaming panel may be associated with a service window application. For example, the service window application itself may also provide access (e.g., a community game panel application displayed in the service window) to the community game panel. In one aspect, the community game panel may require a player to use a player tracking card. Further, the community game panel may require a Client/Server setup whereby each EGM is a client that communicates to a server that coordinates the clients.

To further illustrate the community gaming panel and operations thereof, consider the following examples.

Example #1 (Keno)—Keno Racer

Consider a player that engages an EGM within a gaming venue for playing a Keno game. The player may select, for example, a "Community Panel" (CP) button displayed on the EGM which causes the community panel to appear as an overlay over an existing Keno game the player is currently playing. The community gaming panel overlay may be displayed in the form of a menu that offers different community games and options. Assume one of the community gaming panel selections is a community game titled "Keno Racer."

The player may select this game via the community gaming panel button or some other process (e.g., a voice command instructing the EGM to select the Keno Racer game). The community gaming panel overlay (screen) then changes to display the game settings screen.

On the game settings screen the player may select 1) a number of players, 2) whether the game has open availability or is password protected, and 3) a community wager size. Continuing with the example, assume a player selects 1) number of players as equal to four, 2) password protected as equal to "true" or "on", and 3) a community wager size set at $5.00. The player may then enter a password. To complete the process, the player presses or actuates, for example, a "Submit Game" button or other process for selecting the Submit Game button (e.g., via a voice command). After performing the selection operation such as, for example, pressing or actuating the Submit Game button, the newly created community game may be communicated/sent to all community gaming panel enabled EGMs within a selected area of the gaming venue.

Other players may open the community panel on their particular EGM (the EGM the player is currently using) or a PMD associated with the EGM, and locate the new community game listed in a community gaming panel's "Pending Games" tab. If the other player(s) are interested in the multiplayer game, one or more players may enroll in the community gaming panel game by selecting the multiplayer game in a list within the Pending Games tab. If the multiplayer game is password protected, such as the one described in this example, the player may be required to enter the password to enroll in the community gaming panel game. Assume also that four people enroll in the community game. The wager pool is now $20.00 based on the required minimum bet set by the player creating the multiplayer game (e.g., the $5 wager).

In one aspect, the multiplayer game (e.g., Keno Racer) may be selected or defined as a winner-take-all game. For example, when there are four people enrolled, as defined by the player creating the game, the game begins. Only the game creator will see any "on-screen" graphics displayed on their particular EGM or PMD, and the other three players may need to open the community panel menu to view the status of the game. The reason for this is that the multiplayer game (e.g., Keno Racer) may be linked to the fact that the original player is playing a Keno game on an EGM that is capable of displaying Keno Racer (and its associated graphics) on the screen of the EGM, and the other players are not required to be playing at a "Keno" EGM to join the community game. In fact, other players may play any of the other community panel enabled games within the gaming venue (e.g., poker, slots, etc.).

Continuing with the example, the original player now sees the multiplayer game (e.g., Keno Racer) "on top of" a current game (e.g., the player's original Keno game) the player is or has been playing (presented as another overlay). Events within the current game (e.g., Keno game) may cause the multiplayer game (e.g., Keno Racer) to be played. In one aspect, the multiplayer game (e.g., Keno Racer) may require a standard 8×10 Keno board. Each of the four community players may be assigned a row on the multiplayer game (e.g., Keno Racer) board. Each of the players may be assigned an on-screen marker (an avatar, symbol, etc.) which may be placed at a selected portion (e.g., the leftmost square) in their assigned row of the display.

As an underlying game is played by the controlling player (the original Keno game), if any of the 20 ball drops land on a community player's marker, the avatar may be advanced by one square to the right. The player whose marker "races" across the Keno board and reaches the right-most square in their assigned row is the winner of the multiplayer game (e.g., Keno Racer) and wins the community pool when the ball drop hits this last square. A tie of two or more players having a similar result may be split between the community pool of players using the community panel. At a minimum, this may require the originating player to play 10 Keno games because it will take at least 10 games to move a community player's marker across the 10 column Keno board. The winning player(s) may then receive their winnings via their EGM or PMD and an associated player account.

Example #2 (Poker)—Poker Royalty

In this example, initiating this multiplayer game in the community panel may follow the same process as Example #1. In one aspect, the multiplayer game (e.g., Poker Royalty) may be a multiplayer game (e.g., a 2 or 4 player game) that auto-assigns a different suit to each player in the multiplayer game version (e.g., a 4 player version), and auto-assigns, for example, two different suits in the 2 player version (such that all suits are assigned in either case). The goal of the multiplayer game may be to accumulate the cards that create a "royal flush" (i.e., an Ace, a King, a Queen, a Jack, or a Ten) of the assigned suit. Players may accumulate cards when the originating player is dealt a card that can be assigned to a royal flush hand. The game may become a race and the first person to complete the royal flush hand, for example, wins the game.

Example #3 (Slots)—Favorite Character

Initiating this game in the community panel follows the same process outlined in Example #1. Assume that the originating player is playing a favorite game such as, for example, a game titled after a favorite show (generically titled "Favorite TV Show", by way of example only). In this game, there may be displayed multiple characters such as, for example, four characters from the Favorite TV Show series that may be shown as symbols that appear on the reels of the EGM. The multiplayer game may assign one of these characters to each of the participants. The originating player then plays the underlying game on their respective EGM. The game may have different rules such as, for example, the player that first acquires 100 appearances of their character on the reels is the winner, or the player that is the first to have a line win using all reels and the player's character wins.

Based upon the foregoing example, the multiplayer games of the community gaming panel may each include one or more selected or defined rules. For example, if the originating player performs a cash out operation, loses all winnings/credits, or runs out of wager money/credits, the community game may not continue. Alternatively, the originating player may drop out of the pool, for example, upon performing a cash out operation, losing all winnings/credits, or running out of wager money/credits. In case of originating player drop out, other players that have credits to play can switch to an EGM that supports the multiplayer game and continue playing. At this point, a new player may be deemed a primary or originating player. In an additional aspect, the multiplayer game may be paused until the originating player resumes the multiplayer game. Additionally, the originating player may be blocked from creating community games if for any reason the originating player drops out of the game prior to completion or prior to a predetermined set time required for playing the game (e.g., a rule indicating that each player must play a multiplayer game for at least 5 minutes).

A player may drop out of or exit the multiplayer game at any time, and thereby forfeit their wager. A variety of preferences, factors, parameters, or features may be defined and/or selected for setting up personalized community gaming panels for each player based on their preferences, the factors, the parameters, features, or a combination thereof. For example, each player may create their own avatars, be provided quick-create-game buttons, select a desired theme, or other preferences. In one aspect, the pace-of-play may be defined, set, and/or controlled by an originating player. In an additional aspect, other players may not advance the community game but, rather, only the originating player.

The community gaming panel overlay screen may include: (a) a "Number of Players" selection option (e.g., button) that, when actuated by a first player, causes a first EGM to enable a first player to select the maximum number of players that may enroll in and participate in the multiplayer game; (b) a "Password Protected" selection option (e.g., button) that, when actuated by the first player, causes the EGM to enable the first player (using a PMD in communication with the EGM) to indicate whether the first player desires the gaming system to password protect the multiplayer game; (c) a "Password" selection option (e.g., field) that displays a password (such as a player-created password or a gaming system-created password) required to enroll in the multiplayer game; (d) a "Change Password" selection option (e.g., button) that, when actuated by the first player (using a PMD in communication with the EGM), causes the first EGM to enable the first player to change the password displayed in the Password selection option; (e) a "Multiplayer Game Wager Drop" selection option (e.g., button) that, when actuated by the first player (using a PMD in communication with the EGM), causes the first EGM to enable the first player to select a wager amount that each player must place on the multiplayer game when enrolling in the multiplayer game; (f) a "Multiplayer Game" selection option (e.g., button) that displays an identifying name of the multiplayer game (such as a player-created identifying name or a gaming system-created identifying name); (g) a "Change Name" selection option (e.g., button) that, when actuated by the first player, causes the first EGM to enable the first player to change the identifying name of the multiplayer game displayed in the Multiplayer Game ID selection option (e.g., button); (h) a "Create Multiplayer Game" selection option (e.g., button) that, when actuated by the first player, indicates that the first player desires to create a multiplayer game with the indicated attributes; and (i) a "Back" selection option (e.g., button) to return to a previous selection option. It should be appreciated that the multiplayer game may include any other suitable buttons, fields, and the like having any other suitable functionality instead of, or in addition to, any of those described above.

Additionally, the community gaming panel may include a "Rules" selection option (e.g., buttons, hyperlinks, voice activated commands, etc.), which are respectively associated with each type of community game in the community gaming panel. Each rule selection option, when actuated by a first player, causes a first EGM to provide additional information regarding the rules of the type of multiplayer game associated with the rule with which that rule selection option is associated. For instance, when a first EGM receives an actuation of the rule selection option, the first EGM may display or otherwise provide additional information to the first player regarding the rules of the multiplayer game (which is associated with the rule selection option associated with that particular multiplayer game).

Variations

In various embodiments, if a designated player of a multiplayer game (i.e., the player whose primary game play controls play of the multiplayer game) provided via the community game panel: (a) cashes out of the designated player's EGM, (b) logs out of the designated player's gaming application on the designated player's device, (c) has a credit balance that falls below a threshold amount (such as a minimum wager amount), (d) is idle for at least a designated time period, (e) has not initiated a play of the multiplayer game for at least a designated time period, (f) plays a multiplayer game at a rate below a minimum rate of multiplayer game play, (g) quits the multiplayer game, and/or (h) is playing the multiplayer game on a device that malfunctions (e.g., freezes, experiences a power interruption, and the like), the gaming system: (1) sets one of the other players of the multiplayer game as the designated (controlling) player and continues play of the multiplayer game; (2) pauses the multiplayer game until the original designated player returns, at which point the gaming system continues the multiplayer game; (3) prevents the designated player from creating and/or enrolling in any multiplayer game for a designated time period; (4) ends the multiplayer game and, for each remaining player, returns that player's multiplayer game wager to that player; (5) ends the multiplayer game and, for each remaining player, returns that player's multiplayer game wager to that player and provides that player with a pro-rated portion (based on the number of remaining players) of the original designated player's multiplayer game wager; (6) replaces the designated player with a gaming system-controlled player and continues play of the multiplayer game; (7) pauses the multiplayer game and enables another player to join the multiplayer game as the designated player; (8) adds each remaining player of the multiplayer game to a different multiplayer game (such as another pending multiplayer game of the same type); (9) enables the remaining players to "buy out" the designated player (i.e., the player who exited) to cause the gaming system to resume the multiplayer game, and/or (10) performs a combination of steps (1)-(9).

In certain embodiments, if a non-designated player of a multiplayer game (i.e., the player whose multiplayer game play does not control play of the multiplayer game): (a) cashes out of the player's EGM, (b) logs out of the player's gaming application on the designated player's device, (c) quits the multiplayer game, and/or (d) is playing the multiplayer game on a device that malfunctions (e.g., freezes, experiences a power interruption, and the like), the gaming system: (1) pauses the multiplayer game until the player returns, at which point the gaming system continues the multiplayer game; (2) prevents that player from creating and/or enrolling in any multiplayer games for a designated time period; (3) ends the multiplayer game and, for each remaining player, returns that player's multiplayer game wager to that player; (4) ends the multiplayer game and, for each remaining player, returns that player's multiplayer game wager to that player and provides that player with a pro-rated portion (based on the number of remaining players) of the non-designated player's multiplayer game wager; (5) replaces the player with a gaming system-controlled player and continues play of the multiplayer game; (6) pauses the multiplayer game and enables another player to join the multiplayer game to replace that player; (7) enables the remaining players to "buy out" that player (i.e., the player who exited) to cause the gaming system to resume the multiplayer game; (8) continues play of the multiplayer game; (9) ends the multiplayer game and, for each player including the player who exited, returns that player's multiplayer game wager to that player, and/or (10) performs a combination of steps (1)-(9).

In certain embodiments, the gaming system enables a player of a multiplayer game to quit the multiplayer game at any point in time. In one such embodiment, the gaming system returns the player's multiplayer game wager to the player when the player quits the multiplayer game. In another such embodiment, the gaming system forfeits (i.e., does not return) the player's multiplayer game wager to the player when the player quits the multiplayer game.

In certain embodiments, the gaming system enables each player to customize that player's community panel and store that player's customized community panel selection options in association with that player, such as by using an association with player tracking information of that player. For instance, the gaming system enables each player to: (a) create a customized avatar that the gaming system may employ when displaying the multiplayer game overlay on the device of the designated player during play of the multiplayer game; and (b) create shortcut buttons or enable and define one or more voice activated commands, such as buttons that enable one-touch or one-click creation of a particular multiplayer game and/or voice activated commands that create the particular multiplayer game (such as a multiplayer game having a particular set of attributes) and buttons that enable one-touch or one-click joining of a multiplayer game (such as an already-created multiplayer game satisfying a certain set of criteria).

As noted above, the gaming system enables the player to customize any suitable attributes when creating a multiplayer game. In certain embodiments, the gaming system enables a player to enable gaming system-controlled players to participate in the multiplayer game. In one such embodiment, the gaming system enables the player to affirmatively choose to include one or more gaming system-controlled players to participate in the multiplayer game. In another such embodiment, the gaming system enables the player to choose to enable the gaming system to automatically include up to a certain quantity of gaming system-controlled players as participants in the multiplayer game in the event that enough human players do not enroll in the multiplayer game. For instance, in one example embodiment, the gaming system enables the player to choose to enable the gaming system to automatically fill any remaining spots for a multiplayer game with gaming system-controlled players after a designated time period elapses.

In various embodiments, the gaming system creates one or more multiplayer games via a community gaming panel and enables players to enroll in and participate in those multiplayer games provided in the community gaming panel.

In certain embodiments, the gaming system includes one or more generic multiplayer games that are each supported by any primary game, secondary game, or combination thereof. That is, in these embodiments, the gaming system does not require a player to be playing a particular type of primary game or secondary game to create one of the multiplayer games. In short, a multiplayer game in the community panel (e.g., community gaming panel) may be a primary game, a secondary game, or a combination thereof.

In various embodiments, the gaming system includes one or more multiplayer games that are each supported by any suitable primary game of a particular type. That is, in these embodiments, the gaming system may enable or require a player to be playing a primary game of a particular type to create a multiplayer game associated with that type of game. For instance, in one example embodiment, the gaming system includes a multiplayer game supported by any type of card game. Thus, in this example embodiment, the gaming system requires a player to be playing any type of card game (e.g., a draw poker game, a Pai Gow poker game, a blackjack game, a war game, and the like) to create that particular type of multiplayer game.

In certain embodiments, the gaming system enables a player to create any multiplayer game, regardless of which primary game the player is playing. In one such embodiment, if the designated player is not playing the appropriate primary game when the gaming system initiates the multiplayer game, the gaming system requires the designated player to begin playing the appropriate primary game. In another such embodiment, if the designated player is not playing the appropriate primary game when the gaming system initiates the multiplayer game, the gaming system selects a different player who is playing the appropriate primary game as the designated player. In another such embodiment, if the designated player is not playing the appropriate primary game when the gaming system initiates the multiplayer game, the gaming system creates and employs a gaming system-controlled (virtual) designated player for the play of the multiplayer game.

In certain embodiments, the gaming system enables a player to create any multiplayer game upon authenticating the player with the gaming venue (e.g., providing identification such as, for example, via a player card or biometric data to enroll or login to a player's account associated with the particular gaming venue). In one such embodiment, if the designated player is authenticated upon initiating the creation of the multiplayer game, the gaming system requires the designated player to first enroll or log in to the player's account. In another embodiment, if the designated player is unable to be authenticated, the gaming system selects as the designated player a different player who may be enrolled or logged into a player's account and/or selects a different player to enroll or login to enable the different player to be assigned as a designated player. For example, a prompt may be displayed on an alternative player's community panel (or a voice response may be prompted from an alternative player's EGM or PMD) which indicates that another player has failed to be authenticated. The alternative player may then be requested to be assigned as the designated player thereby instructing the alternative player to create, initiate, or resume a multiplayer game in the community panel having a community pool of players.

In various embodiments, certain of the multiplayer games include interim goals that, when reached by a player of the multiplayer game, cause the gaming system to provide an interim award to that player. For instance, in a variation of the slot multiplayer game described above, the slot multiplayer game includes: (a) an interim goal of achieving a designated combination of player-associated symbols, and (b) a final goal of achieving 100 player-associated symbols. These interim goals and associated interim awards keep players interested throughout the entire play of the multiplayer game.

It should be appreciated that, for a given multiplayer game, the gaming system provides player tracking points (or any other suitable player loyalty points) while the designated player is playing the primary game that controls play of the multiplayer game. These tracking points may be saved for display in the community gaming panel, a service window, or both. In certain embodiments, the gaming system provides a certain percentage (which may be any suitable percentage) of the player tracking points earned by the designated player during play of the multiplayer game that controls play of the multiplayer game to the other players of the multiplayer game. For instance, if the designated player earns 250 player tracking points during play of the multiplayer game while the multiplayer game is in play, the gaming system provides 25 player tracking points (or 10% of that earned quantity) to each of the other players of the multiplayer game. This incentivizes players to join as many multiplayer games as possible to dramatically increase their rate of earning player tracking points.

In certain embodiments, the gaming system enables each player to enroll in only one multiplayer game at any given point in time. In other embodiments, the gaming system enables each player to enroll in up to a designated quantity of multiplayer games at any given point in time. In further embodiments, the gaming system does not limit the number of multiplayer games in which each player may enroll.

In various embodiments, players may enroll in a multiplayer game using the same device. For example, the maximum quantity of four players may enroll in a slot multiplayer game using a single EGM in communication with multiple PMDs, and the designated player may then play the associated multiplayer slot game at that same EGM, which controls play of the slot multiplayer game, while the remaining three players use their PMDs that are in communication with the single EGM being played by the designated player.

In certain embodiments, the gaming system does not require a player to have a player tracking account or a player tracking card to enroll in and participate in a multiplayer game. Rather, any other type of data that may be verified may be used. In these embodiments, the gaming system enables the player to otherwise identify himself/herself (such as by the use of a unique username combined with a personal identification number (PIN)) when enrolling in a multiplayer game. Additionally (or alternatively), biometric data (e.g., retinal scan, voice detection, fingerprint, etc.) may be used for verifying the player with the gaming venue. In one such embodiment, the gaming system requires a player to enroll in the multiplayer game using the device of the designated player, while in another embodiment the gaming system has no such requirement. In one embodiment, regardless of the device (e.g., EGM or PMD) that such a player employs to enroll in the multiplayer game, the player obtains any awards for the multiplayer game from the device of the designated player.

In various embodiments, the gaming system enables a player of a multiplayer game to obtain any awards won during the multiplayer game at a kiosk or cashier within the gaming venue instead of at the player's device.

In certain embodiments, when a player is enrolled in an ongoing multiplayer game and the player's community panel window is closed (e.g., minimized upon commencement of the multiplayer game), the player's device automatically opens the community gaming panel window whenever the multiplayer game progresses. In other embodiments, when a player is enrolled in an ongoing multiplayer game and the player's community gaming panel window is closed, the player's device automatically opens the community gaming panel window whenever the multiplayer game progresses with respect to that particular player. In further embodiments, when a player is enrolled in an ongoing multiplayer game and the player's community gaming panel window is closed, the player's device displays a pop-up window informing the player whenever the multiplayer game progresses. In other embodiments, when a player is enrolled in an ongoing multiplayer game and the player's community gaming panel window is closed, the player's device displays a pop-up window informing the player whenever the multiplayer game progresses with respect to that particular player.

In various embodiments, one or more of the multiplayer games have qualification criteria that a player must satisfy before the gaming system enables the player to create and/or join that multiplayer game. For instance, in one example embodiment, the gaming system enables a player to join a particular multiplayer game only if the player's player loyalty ranking exceeds a designated ranking (e.g., a player having reached a designated loyalty rank enabling the player to be eligible for a wider range of bonuses, services, discounts, promotions, credits, multiplayer games, or other specified rewards). In another example embodiment, the gaming system enables the player to join a particular multiplayer game only if the player's average wager over a designated period of time exceeds a threshold amount. In yet another example embodiment, the gaming system enables the player to join a particular multiplayer game only if the player's average rate of play over a designated period of time exceeds a threshold rate. In still another example embodiment, the gaming system enables the player to join a particular multiplayer game only if the denomination of wager at which the player is playing the player's primary game exceeds a designated amount.

It should be appreciated that the gaming system may display the multiplayer game window in any suitable manner, such as (but not limited to): (a) on the primary display device of a device (EGM and/or PMD), (b) on a secondary display device of the device (such as a top box or a player tracking display), (c) in a service window of the device, (d) on a separate device (such as the player's smartphone, tablet computing device, or alternative PMD), and/or (e) on a device of one or more persons who are not enrolled in the multiplayer game (such as spectators in a gaming establishment, spectators logged into an online casino, or casino personnel).

It should be appreciated that the present disclosure contemplates players being able to enroll in and participate in one or more multiplayer games via an online casino establishment. In certain such embodiments, the gaming system enables players playing on EGMs at a brick-and-mortar gaming venue, and players playing at an online casino using their PMDs to enroll in and participate in the same multiplayer game. In other such embodiments, the gaming system enables: (a) players playing on EGMs at a brick-and-mortar gaming establishment (and not players of an online casino) to enroll in and participate in the same multiplayer game, and (b) players playing at an online casino using their PMDs (and not players playing on EGMs at a brick-and-mortar gaming establishment) to enroll in and participate in the same multiplayer game.

Gaming Systems

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices in the form of PMDs, such as desktop computers, laptop computers, tablet computers or computing devices, personal digital assistants (PDAs), mobile telephones such as smartphones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more PMDs, one or more EGMs, and one or more central servers, central controllers, or remote hosts in combination with one another; (e) a single EGM; (f) a plurality of EGMs in combination with one another; (g) a single PMD; (h) a plurality of PMDs in combination with one another; (i) a single central server, central controller, or remote host; and/or (j) a plurality of central servers, central controllers, or remote hosts in combination with one another.

Turning now to FIG. 1, a block diagram illustrating a gaming system environment 100 is shown, in which aspects of the present disclosure may be implemented within and upon. Environment 100 includes a Gaming Terminal Data Repository (GTDR) connected via one or more network interface(s) to a gaming network which, for example, may include gaming devices (e.g., gaming terminals) and/or other devices, in which aspects of the present disclosure may be realized. As illustrated in FIG. 1, the gaming environment 100 may comprise a gaming system/environment 122 located in a physical environment (not shown). It will be appreciated that the communication links between the various components may be separate and distinct or may be commonly used. It will also be appreciated that one or more of the functions or applications described above may be consolidated, such as at a common server or host. Further, other components for implementing other functionality may be provided. For example, a variety of computing devices, such as user stations, may be connected to the various systems. Printers and other peripheral devices may also be connected to each network or system. A gaming system/environment 122 may be located at least partially in one or more physical gaming environments, such as a casino, restaurant, and/or convenience store. For example, the casino may include publicly accessible game areas where certain of the gaming system devices 124, such as gaming machines 125 and table games 127 are located, as well as secure areas where the servers and other components are located.

In one embodiment, the physical environment includes at least a portion of a physical structure, such as a casino, housing one or more components of the gaming system/environment 122. The gaming system/environment 122 includes one or more gaming system devices 124 or components. The gaming system devices 124 may include gaming machines 125, such as those known as video or slot machines. The gaming system devices 124 may also include "table" games 127 such as Blackjack and Roulette. The gaming system devices 124 may also include components or devices such as player tracking card readers 129, coin counters and other gaming device functionality options, which devices or components may be linked or associated with other devices. The devices or components may also comprise computers or servers and communication equipment, cashier and accounting workstations, and a wide variety of other elements.

In one embodiment, the gaming system/environment 122 may include a variety of sub-systems. These sub-systems may be partially or fully independent of one another or may be related. In one embodiment, each system may be included or be part of a network. In one embodiment, the gaming system/environment 122 may include a game presentation/operation system, which includes at least one game server 126. The game server 126 may comprise a computing device including a processor and a memory. The game server 126 may be adapted to perform a variety of functions. This functionality may be implemented by software and/or hardware of the game server 126. In one embodiment, the game server 126 may be arranged to provide information or instructions to the one or more gaming system devices 124 or individual gaming system components. The information may comprise game code and control data. In one embodiment, the game server 126 may also be arranged to accept information from the gaming system devices 124 or components. For example, the game server 126 may accept information regarding the status of operation of a particular gaming system device 124 (such as "normal" or "malfunction").

In one embodiment, the game server 126 is part of a network, which includes a communication link between the game server 126 and selected gaming system device(s) 124 and/or other component(s) with which communication is desired. A communication interface may be associated with the game server 126 and each device or component for facilitating the communication. The communication interfaces may have a variety of architectures and utilize a variety of protocols such as IEEE-1394 (FireWire™) or Ethernet in the case where the communication link is a wired link, or a wireless link utilizing a wireless protocol such as WIFI, Bluetooth™, Radio Frequency (RF), Infrared, third generation partnership project (3GPP) long term evolution (LTE), Worldwide interoperability for Microwave Access (WiMAX), High Speed Packet Access (HSPA), etc. The communication links may transmit electrical, electromagnetic or optical signals, which carry digital data streams, or analog signals representing various types of information. In one embodiment, such as when the gaming system device 124 comprises a gaming machine 125, the gaming system device 124 may include a master gaming controller, which controls the functions of game operation. The communication interface may be associated with the master gaming controller, permitting data to be transmitted between the game server 126 and the master gaming controller.

In one embodiment, the gaming system/environment 122 may include a player tracking system, which includes at least one player-tracking server 128. The player-tracking server 128 may also comprise a computing device including a processor and a memory. The player-tracking server 128 may be adapted to perform player-tracking functions. For example, the player-tracking server 128 may store information regarding the identities of players and information regarding the game play of those players. This information may include time of play, coin in/coin out or other monetary transaction data, and in an arrangement where players are awarded points based on play, a player's point total. Once again, the player tracking system includes a network comprising a communication link provided between the player-tracking server 128 and one or more of the gaming system devices 124 having a player-tracking function or other components of the gaming system/environment 122 associated with the system. In one embodiment, such as where the gaming system device 124 comprises a gaming machine, the device may include a management interface board, which controls a card reader. The management interface board may be arranged to receive data from the master gaming controller of the gaming system device 124. A communication interface is associated with the management interface board, permitting data to be transmitted between the player-tracking server 128 and the management interface board.

In the case of table games, a card reader 129 may be associated with the table (e.g., the card reader located on or near the table game). Players may utilize the card reader to identify themselves. Information regarding play of the table game may be input through an input device by a dealer, coin counter or the like, and this information may be transmitted to the player-tracking server 128.

In one embodiment, the gaming system/environment 122 may include an accounting system, which includes at least one accounting server 130. The accounting server 130 may comprise a computing device including a processor and a memory. The accounting server 130 is preferably adapted to perform financial related functions, such as tracking financial transactions such as bets and payouts, and performing reconciliations with monies collected from the gaming system devices 124, such as gaming machines 125 and table games 127. The accounting server 130 may be associated with a wide variety of devices, including individual gaming system devices 124 and other servers. Once again, a communication link may be provided between the accounting server 130 and each device with which communication is desired.

In one embodiment, the gaming system/environment 122 may include a progressive award system, which includes at least one progressive server 132. The progressive server 132 may comprise a computing device including a processor and a memory. The progressive server 132 may be designed to generate progressive award information. In one arrangement, the progressive server 132 may obtain information regarding amounts bet at specific gaming system devices 124, such as gaming machines 125 or table games 127. Utilizing this information, a progressive jackpot award amount may be generated and updated using a specified protocol. The information may be transmitted to one or more displays 134 associated with participating gaming system devices 124. Once again, a communication link is preferably provided between the progressive server 132 and each device with which communication is desired. For example, a link may be provided between the progressive server 132 and accounting server 130 for providing payout information to the accounting server 130. The accounting server 130 also reads the paid amounts from the electronic gaming machines 125 as well and makes sure the paid amounts match what the progressive server claimed the paid amounts should have been. If the paid amounts do not match, then the accounting server 130 may raise a flag for further investigation by casino staff or regulators.

A physical and/or virtual information host 136 is associated with or comprises a portion of the gaming system/environment 122. In one embodiment, the host 136 comprises a computing device, which includes a processor, memory and a display. The virtual information host 136 may be one or more devices separate from devices performing other functions of the system/environment 122, or may be integrated with existing devices. The virtual information host 136 may be designed and adapted to perform functions relating to acquiring, managing, rendering, generating and/or displaying real-time and/or non real-time casino gaming system or "gaming environment" graphical information and information regarding one or more components of the gaming system or environment. Such functionality may also include the generation of at least one graphical user interface on at least one mobile device (e.g., mobile device 131), which is configured or designed to graphically display information (e.g., real-time casino information) relating to selected aspects of casino activity. Also, different graphical user interfaces may be displayed on an external application, such as on an application of a computer, smartphone, and/or on any type of mobile device 131. In one embodiment, bi-directional communication channels 121 are provided for direct, two-way communication between the host 136 and at least one game server 126 and at least one player-tracking server 128, and/or any other device with which communication is desired.

As illustrated in the example of FIG. 1, gaming system/environment 122 may also include one or more mobile devices 131 configured or designed to communicate, via one or more wireless links 111, with various components of the gaming environment 100 such as, for example: information systems (e.g., virtual information host 136); player-tracking systems; accounting systems; employee management systems; location positioning systems (e.g., GPS system 133); game servers; surveillance systems; security systems; communication systems; gaming systems (e.g., gaming machines 125, game table devices 127, other mobile devices 131, etc.); etc.

Figure 2:
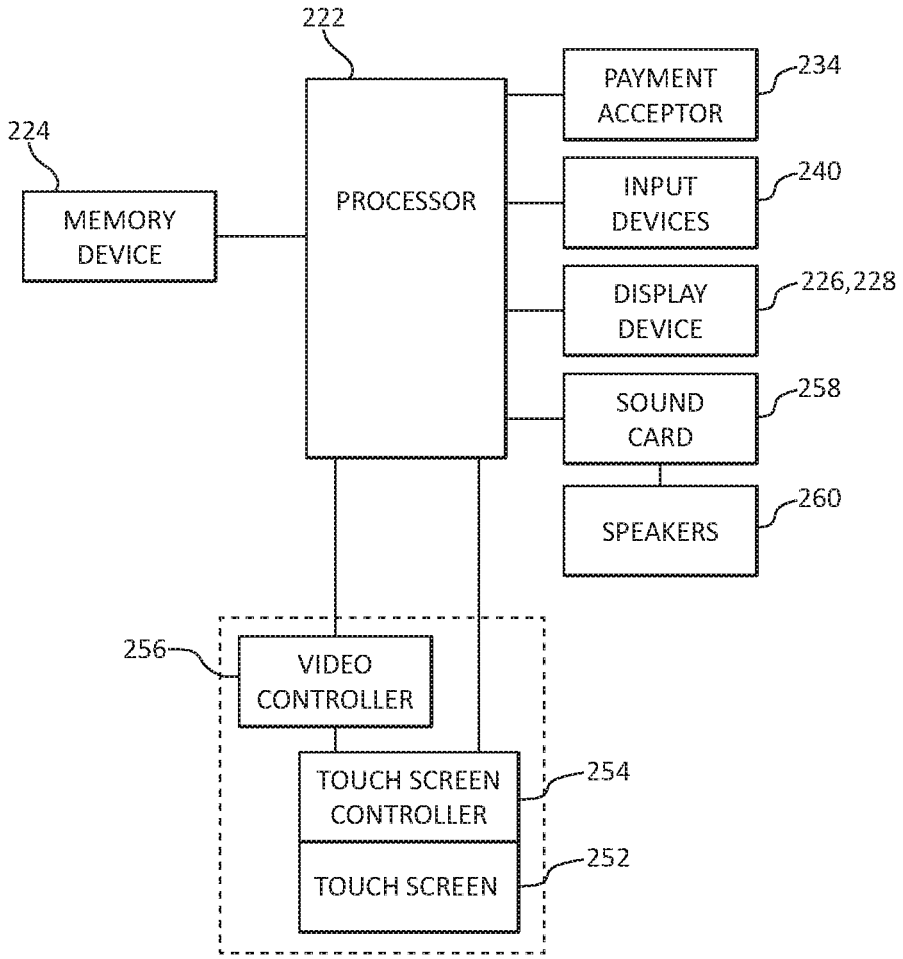
FIG. 2 is a block diagram illustrating an electronic configuration for use in the gaming device of FIG. 1.

FIG. 2 is a block diagram illustrating an electronic configuration for use (for example in the gaming machine 125) of FIG. 1, here again in which aspects of the present disclosure may be realized. In the embodiment illustrated in FIG. 2, the player station may include at least one processor 222, such as a microprocessor, a microcontroller-based platform, a suitable integrated circuit, or one or more ASICs.

The processor 222 is in communication with or operable to access or to exchange signals with at least one data storage or memory device 224. In one embodiment, the processor 222 and the memory device 224 reside within the cabinet of the player station. The memory device 224 stores program code and instructions, executable by the processor 222, to control the player station. The memory device 224 also stores other data such as image data, event data, player input data, random or pseudo-random number generators, pay-table data or information and applicable game rules that relate to the play of the player station. In one embodiment, the memory device 224 includes random access memory (RAM), which can include non-volatile RAM (NVRAM), magnetic RAM (MRAM), ferroelectric RAM (FeRAM), and other forms as commonly understood in the gaming industry. In one embodiment, the memory device 224 includes read only memory (ROM). In one embodiment, the memory device 224 includes flash memory and/or EEPROM. Any other suitable magnetic, optical and/or semiconductor memory may operate in conjunction with the player station and gaming system disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop personal computer, a PDA, portable computing device, or other computerized platform to implement the present disclosure. In one embodiment, the gaming system is operable over a wireless network, such as part of a wireless gaming system. In this embodiment, the player station may be a hand-held device, a mobile device or any other suitable wireless device that enables a player to play any suitable game at a variety of different locations. It should be appreciated that a player station as disclosed herein may be a device (e.g., EGM) that has obtained approval from a regulatory gaming commission or a device that has not obtained approval from a regulatory gaming commission. It should be appreciated that the processor and memory device may be collectively referred to herein as a "computer" or "controller."

In one embodiment, a background play feature may be available where a player, who may be sitting at the lounge and/or at the bar with friends (at the casino) may be playing a machine from the floor by remote via the external application(s) (e.g., via the one or more mobile devices 131). The player may substitute into the same game he wanted from a Gaming Vendor online game and play, or backend the actual game though a venue network. The game may be bankrolled by the venue the player was inside. If the player was to win, the player could collect from that venue where the player was located, and/or instead of "reserving" a machine he could continue the game with an auto play during a period of time the player took a break/recess. In one embodiment, a team game may be played by a group of players (e.g., a group of 3 or 4 players) and the group of players may watch and/or play the same game on each player's individual mobile device (e.g., a computer, tablet, and/or smartphone). Similarly, as described above, the team game may be played by a group of players from a remote location (e.g., bar, lounge, casino, home, office, restaurant, etc.). In one embodiment, the team game may be played by a group of players and the group of players may share credit inputs and wins. In one embodiment, the team game may be played by the group of players and the group of players may sell off and/or share double up options and/or credits to other team players of the group.

In one embodiment, as mentioned above and seen in FIG. 2, one input device is a touch-screen 252 coupled with a touch-screen controller 254, or some other touch-sensitive display overlay to allow for player interaction with the images on the display. The touch-screen and the touch-screen controller are connected to a video controller 256. A player can make decisions and input signals into the player station by touching the touch-screen at the appropriate places. One such input device is a conventional touch-screen button panel. In another embodiment, a plurality or each of the display segments is a touch-screen 252 coupled with a touch-screen controller 254 or some other touch-sensitive display overlay to allow for player interaction with the images on the display segments. The touch-screens 252 and the touch-screen controllers 254 are connected to a video controller. The player station may further include a plurality of communication ports for enabling communication of the processor with external peripherals, such as external video sources, expansion buses, game or other displays, an SCSI port, or a key pad. In one embodiment, at least one payment acceptor 234 (which may communicate with processor 222 for playing a bet) input devices 240, and display devices 226, 228 are provided.

The player stations, the central controller, and the display segments may include serial interfaces and/or Ethernet (e.g., G2S (game-to-system) protocol uses commodity Ethernet equipment and TCP/IP) to connect to specific subsystems or subnets internal and external to the player stations, central controller and the display segments. The serial devices may have electrical interface requirements that differ from the "standard" EIA serial interfaces provided by general-purpose computers. These interfaces may include EIA, Fiber Optic Serial, optically coupled serial interfaces, current loop style serial interfaces, etc. In addition, to conserve serial interfaces internally in the player station, serial devices may be connected in a shared, daisy-chain fashion where multiple peripheral devices are connected to a single serial channel.

The serial interfaces and/or Ethernet (e.g., G2S (game-to-system) protocol uses commodity Ethernet equipment and TCP/IP) may be used to transmit information using communication protocols that are unique to the gaming industry. For example, SAS is a communication protocol used to transmit information, such as metering information, from a player station to a remote device. Often SAS is used in conjunction with a player tracking system. EGMs may be treated as peripheral devices to a casino communication controller and connected in a shared daisy-chain fashion to a single serial interface and/or Ethernet. In both cases, the peripheral devices are preferably assigned device addresses. If so, the serial controller circuitry must implement a method to generate or detect unique device addresses. In one embodiment, security-monitoring circuits detect intrusion into a player station or gaming station by monitoring security switches attached to access doors in a designated area, such as a player station cabinet. In one embodiment, access violations result in suspension of game play and can trigger additional security operations to preserve the current state of game play. These circuits also function when power is off by use of a battery backup. In one embodiment, as seen in FIG. 2, the player station includes a sound generating device controlled by one or more sound cards 258 which function in conjunction with the processor. In one embodiment, the sound generating device includes at least one and preferably a plurality of speakers 260, which may be part of a distributed speaker system, or other sound generating hardware and/or software for generating sounds, such as playing music for the primary and/or secondary game or for other modes of the player station, such as an attract mode. In one embodiment, the player station provides dynamic sounds coupled with attractive multimedia images displayed on one or more of the display devices to provide an audio-visual representation or to otherwise display full-motion video with sound to attract players to the player station. During idle periods, the player station may display a sequence of audio and/or visual attraction messages to attract potential players to the player station. The videos may also be customized for or to provide any appropriate information.

In one embodiment, the gaming system may include a sensor, such as a camera in communication with the processor (and possibly controlled by the processor) that is selectively positioned to acquire an image of a player actively using the player station and/or the surrounding area of the player station. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia. In another embodiment, the gaming system includes a wireless transceiver or a camcorder and the display segments are components of or are connected to televisions, satellites, DVD players, digital video recorders and Internet-enabled devices. In one embodiment, the game may be displayed on the central display and replicated on one or more the player stations. In another embodiment, the game is only displayed on the central display and the player station is only used to input decisions or commands in the game. In another embodiment, a primary or base game is displayed on the player station and/or the central display and one or more bonus games are displayed on the central display only. In one embodiment, the player stations provide other information to a player, such as the win/loss history of that certain game or the win/loss history of that player. It should be appreciated that the central display and the player stations may work together with a central controller or a plurality of servers to provide the games to the player in any suitable manner.

Figure 3:
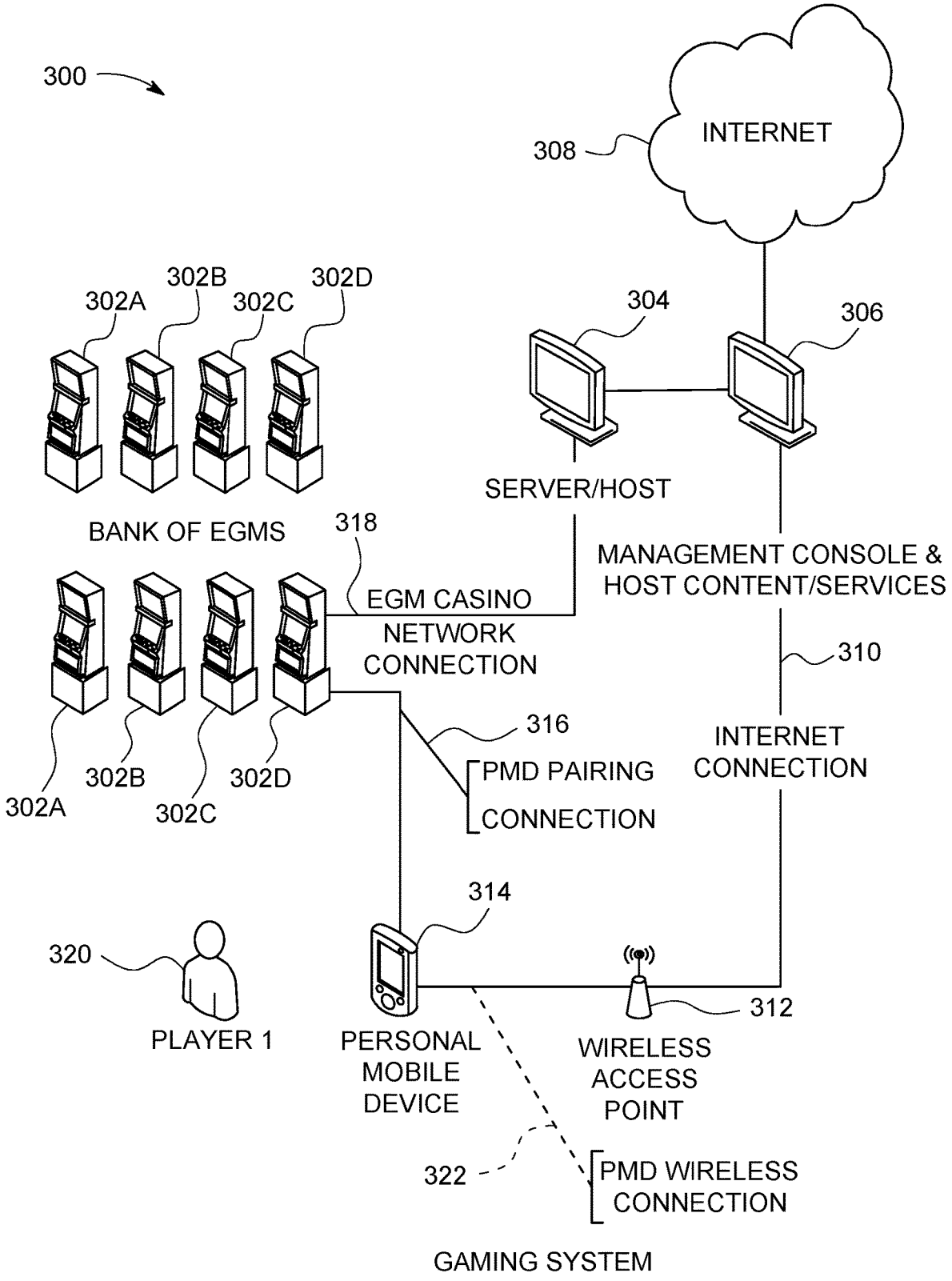
FIG. 3 is a block diagram illustrating a gaming system which contains multiple EGMs.

Having described one or more gaming venues and/or EGM architectures, functionality, and/or systems and methods of operations, turning now to FIG. 3, a block diagram illustrating a gaming system 300 containing multiple EGMs is depicted. Players 320 (and perhaps operators and regulators, collectively illustrated in FIG. 5 as 'player A') employ mobile devices such as PMDs 314 that are used for various operations on the casino network 318 and the EGMs 302 (illustrated in FIG. 3 as 302A-D). Specifically, the PMDs 314 allow the players 320 to communicate with the EGMs 302 at which they are seated or physically located near to, in order to access game or player account features. The players 320 can also use their PMDs 314 to access the network 318 of the casino or the Internet 308, using, for example, the wireless access point 312 for the Internet connection 310. The players 320 may use a web browser on their PMDs 314 or applications (related to the gaming establishment or otherwise) installed on their PMDs 314 that access the network 318.

As illustrated in FIG. 3, the player 320 may be an authenticated player (e.g., a "carded" player) seated at an EGM such as, for example, EGM 302D, which is located within a bank of EGMs 302 (e.g., EGMs 302A-302D). In one aspect, the carded player may be a player identified with a game, an EGM, a gaming operator (e.g., a casino), or a combination thereof. The identification process may occur using an identification card or device presented by the player 320 and inserted, and/or provided to a card reader, a scanner, or bar code reader of the EGM 302D. Additionally, the identification process may include a login operation whereby the player performs a login process to the EGM or a gaming server (perhaps operated by the game owner). The player 320 may carry PMD 314 which has wireless capabilities (such as via WIFI, Bluetooth™, RF, Infrared, 3GPP, LTE, WiMAX, HSPA or other wireless communication networks) and may connect and communicate with the Wireless Access Point (WAP) 312 through PMD wireless connection 322. In one embodiment, the WAP 312 may be a commodity, "off the shelf" device. The server/host 304 shown is part of the casino service based system and/or host system. In one embodiment, the community gaming panel (or "community panel"), gaming content, and/or services related to the EGMs 302A-302D may be installed and loaded onto the PMD 314. This content may be managed, controlled, and/or operated by the management console and host content/services 306 which may be included within the server/host 304 and/or remotely located and in communication with the server/host 304. In one embodiment, the PMD 314 may be directly paired with at least one of the EGMs 302 and/or the server/host 304 using the pairing connection 316.

Figure 4:
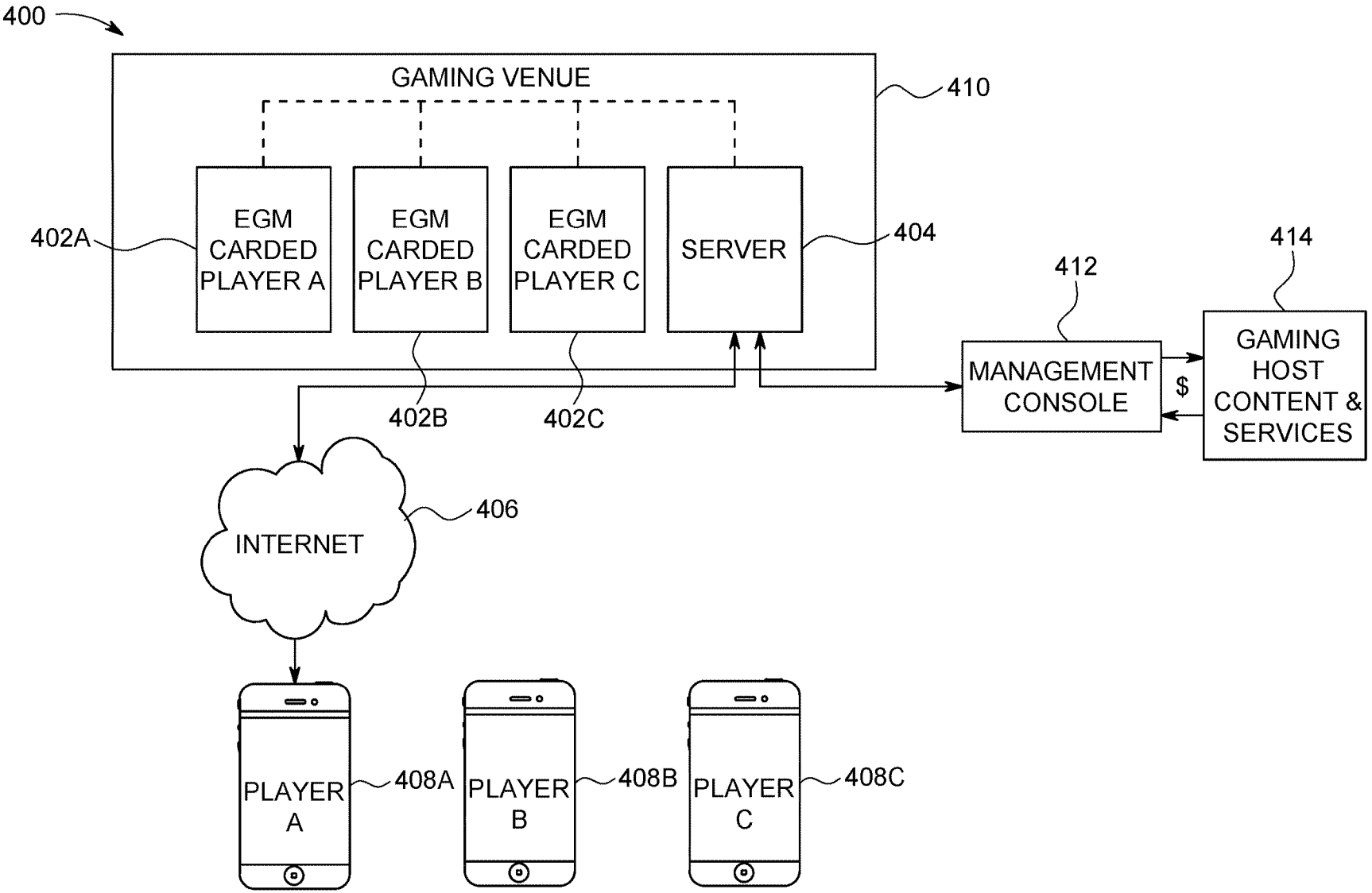
FIG. 4 is a block diagram illustrating an additional gaming system for extending gaming and services of an authenticated player to a smartphone with a community game panel displayed therein.

As an additional example, consider the gaming system 400 of FIG. 4 for extending gaming and services of an authenticated player (e.g., a carded player) to a smartphone with a community game panel displayed therein. The exemplary gaming system 400 may include a gaming venue 410, a data network (e.g., Internet) 406, and one or more PMDs (e.g., smartphones/mobile devices, tablet computers, etc.) such as, for example, PMDs 408A-C.

The gaming venue 410 may include one or more EGMs such as, for example, EGMs 402A-402C having a wireless connection with one or more servers such as, for example, server 404. The one or more EGMs such as, for example, EGMs 402A-402C and server 404 may also have a wireless connection via a data network such as, for example, through Internet 406 with PMDs 408A-C. The EGMs 402A-C may include one or more specific mobile applications such as, for example, a gaming establishment mobile application associated with the gaming venue itself and/or a mobile game application. In one aspect, one or more EGMs such as, for example, EGMs 402A-C, and/or server 404 may extend gaming and services to a PMD 408A-C of an authenticated player (e.g., a carded player) for one or more EGMs 402A-402C. Management console 412 and gaming host content and services 414 may be included and stored locally on server 404. Alternatively, management console 412 and gaming host content and services 414 may be remotely located from server 404 and each function as an independent server in communication with server 404.

Consider, for illustration purposes, a community gaming panel of EGM 402A has been installed on PMD 408A. PMD 408A may be remotely connected to the EGM 402A and/or server 404. PMD 408B may be remotely connected to EGM 402B and/or server 404. PMD 408C may be remotely connected to EGM 402C and/or server 404. In an additional aspect, PMDs 40A-C may be remotely connect to EGM 402A, EGM 402B, EGM 402C, server 404, or a combination thereof.

Assume a first carded player such as, for example, player A has registered/signed into EGM 402A using a player's card device such as, for example, PMD 408A. Player A may be enabled to initiate the multiplayer game on the PMD 408A for multiplayer game play. One or more additional carded players may be registered/signed into one or more alternative EGMs. For example, player B may be registered/signed into EGM 402B using a player's card device such as, for example, PMD 408B, and player C may be registered/signed into EGM 402C using a player's card device such as, for example, PMD 408C. Player B may be enabled to access the multiplayer game of EGM 402B on PMD 408B to enroll in the multiplayer game originating on EGM 402A. Player C may be enabled to access the multiplayer game of EGM 402C on PMD 408C to enroll in the multiplayer game originating on EGM 402A. The multiplayer game may be funded by one or more wagers by the first authenticated player (e.g., player A), the one or more additional authenticated players (e.g., player B, player C, or both), a gaming venue, a third party funding source, or a combination thereof. This funding may be tied to the respective player's gaming venue account to receive potential winnings, awards, loyalty points, prizes, rewards, services, or a combination thereof resulting from one or more game wins of the multiplayer game.

The multiplayer game originating on EGM 402A may be synchronized between EGM 402A and the one or more alternative EGMs 402B-402C for the multiplayer game play between PMD 408A and the one or more alternative PMD 408B, and/or PMD 408C. Thus, the multiplayer game on the PMD 408A may be provided by EGM 402A associated with the carded player A. The multiplayer game on the PMD 408B may be provided by EGM 402B and associated with the carded player B. The multiplayer game on the PMD 408C may be provided by EGM 402C and associated with the carded player C. An outcome may be determined for the multiplayer game based at least in part on one or more plays of the multiplayer game by the player A using PMD 408A, the additional player B using PMD 408B, the additional player C using PMD 408C, or some combination thereof. In one aspect, one or more winnings, awards, loyalty points, prizes, rewards, services or a combination thereof may be provided for each determined outcome for the multiplayer game by one or more of the players. The determined outcome may be one or more game wins of the multiplayer game.

In an additional aspect, server 404 may enable players of the EGMs 402A-C to enroll in and participate in a multiplayer game using the multiplayer game on the PMDs 408 by either: (a) creating and enrolling in a multiplayer game, (b) enrolling in a multiplayer game already created by another player, or (c) creating and enrolling in a multiplayer game and enrolling in another multiplayer game already created by another player.

In an additional aspect, server 404 may enable a player such as, for example, players A-C, to customize that player's community panel and store that player's customized community panel in association with that player, such as in association with player tracking information of that player. For instance, the server 404 enables each player to: (a) create a customized avatar that the gaming system may employ when displaying the multiplayer game overlay on the device of the designated player during play of the multiplayer game; and (b) create shortcut buttons, such as buttons that enable one-touch or one-click creation of a particular multiplayer game (such as a multiplayer game having a particular set of attributes) and buttons that enable one-touch or one-click joining of a multiplayer game (such as an already-created multiplayer game satisfying a certain set of criteria).

Figure 5:
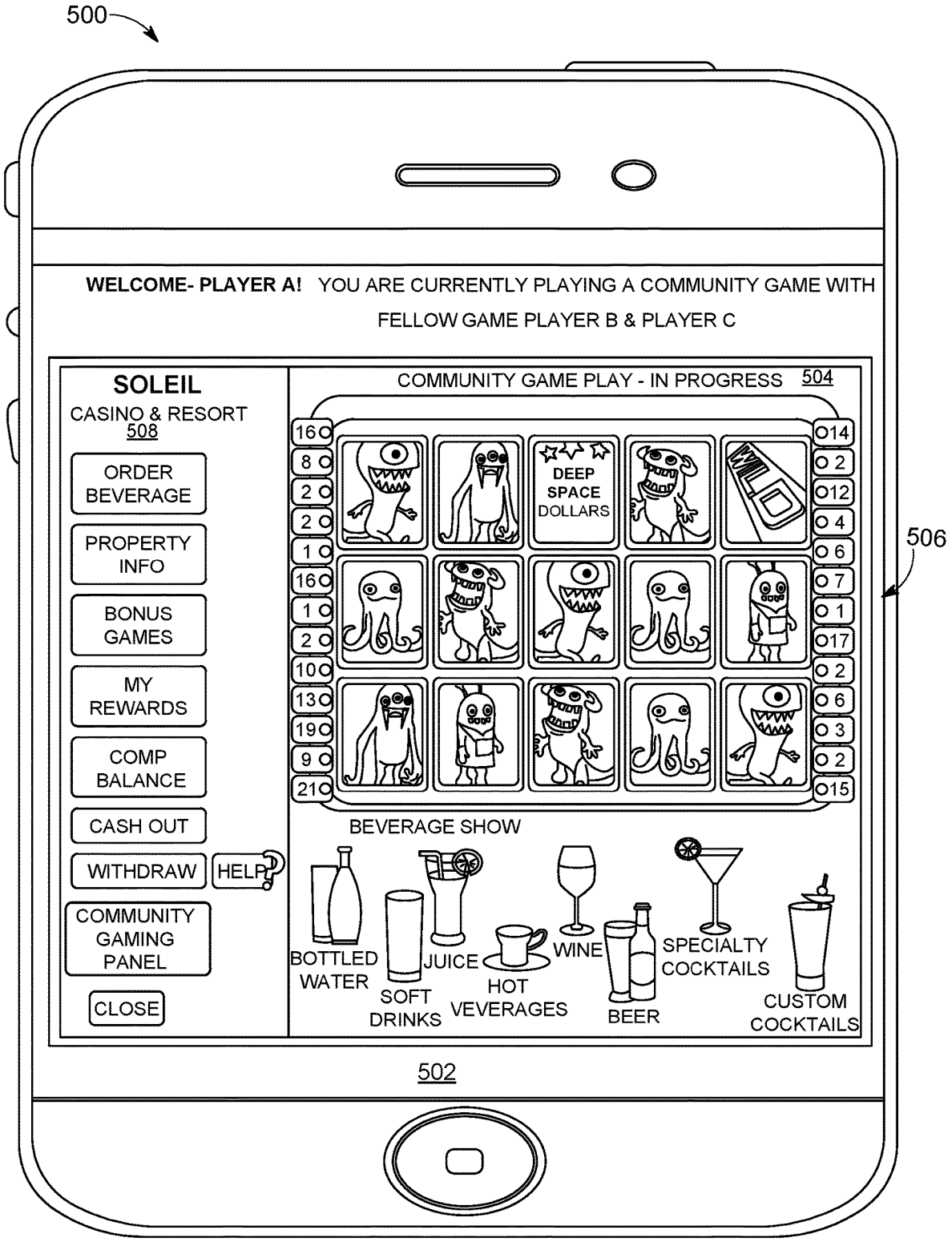
FIG. 5 is a block diagram illustrating a personal mobile device (PMD) with extended gaming and services from an electronic gaming machine (EGM) for an authenticated player.

Turning now to FIG. 5, a block diagram illustrating a PMD 500 is depicted, for extended gaming and services from an EGM for an authenticated player (e.g., a carded player) associated with the EGM. A community gaming panel 502 may comprise an application transferred from an EGM onto the PMD 500, which is in communication with the EGM. That is, the community gaming panel may be installed on a the PMD 500. The PMD 500 working in conjunction with the EGM and/or a server associated with an EGM (such as those described in FIG. 3), enables a player to customize that player's community gaming panel 502 and store the customized community gaming panel 502 on the PMD, an EGM, a server associated with the EGM, or a combination thereof.

The PMD 500 may include an interactive GUI 506 for displaying the community gaming panel 502, installed thereon, that may also be associated with and/or provided by an EGM/server. The community gaming panel 502 may include one or more multiplayer games, gaming content, and/or services. That is, the community gaming panel 502 (which may include a community panel window 504) may include and/or display via the interactive GUI 506 a name of a gaming venue (e.g., "Soleil Casino & Resort"), one or more services or information (e.g., ordering a beverage, property information, bonus games, player awards, compensation balances, cash-in or cash-out functions, and the like), and/or gaming content. That is, the community gaming panel 502 may also include a service window application 508 to provide the one or more services and gaming content provided in the community gaming panel. For example, the service window application 508 may include a community gaming panel button enabling a player to select the community gaming panel button for accessing one or more multiplayer games provided in the community gaming panel 502.

In one aspect, when a player is enrolled in an ongoing multiplayer game, the player's community panel window on the PMD 500 may be opened, partially opened, and/or closed. In an additional aspect, the player's PMD 500 may also automatically open the community panel window whenever a multiplayer game is initiated by another player, in progress, or upon a player connecting the PMD 500 with a selected EGM. In other embodiments, when a player is enrolled in an ongoing multiplayer game and the player's community panel window 504 is closed, the player's device automatically opens the community panel window 504 whenever the multiplayer game progresses with respect to that particular player.

In further embodiments, when a player is enrolled in an ongoing multiplayer game and the player's community gaming panel window 504 is partially-closed (e.g., a services section of area may be minimized while only displaying game play of a multiplayer game or vice versa) or fully closed, the PMD 500 may display a pop-up window on the PMD 500 informing the player whenever the multiplayer game progresses. In other embodiments, when a player is enrolled in an ongoing multiplayer game and the player's community gaming panel window 504 is closed, the player's device displays a pop-up window informing the player whenever the multiplayer game progresses with respect to only that particular player (e.g., only displaying the pop-up window when it is the player's turn).

Figure 6:
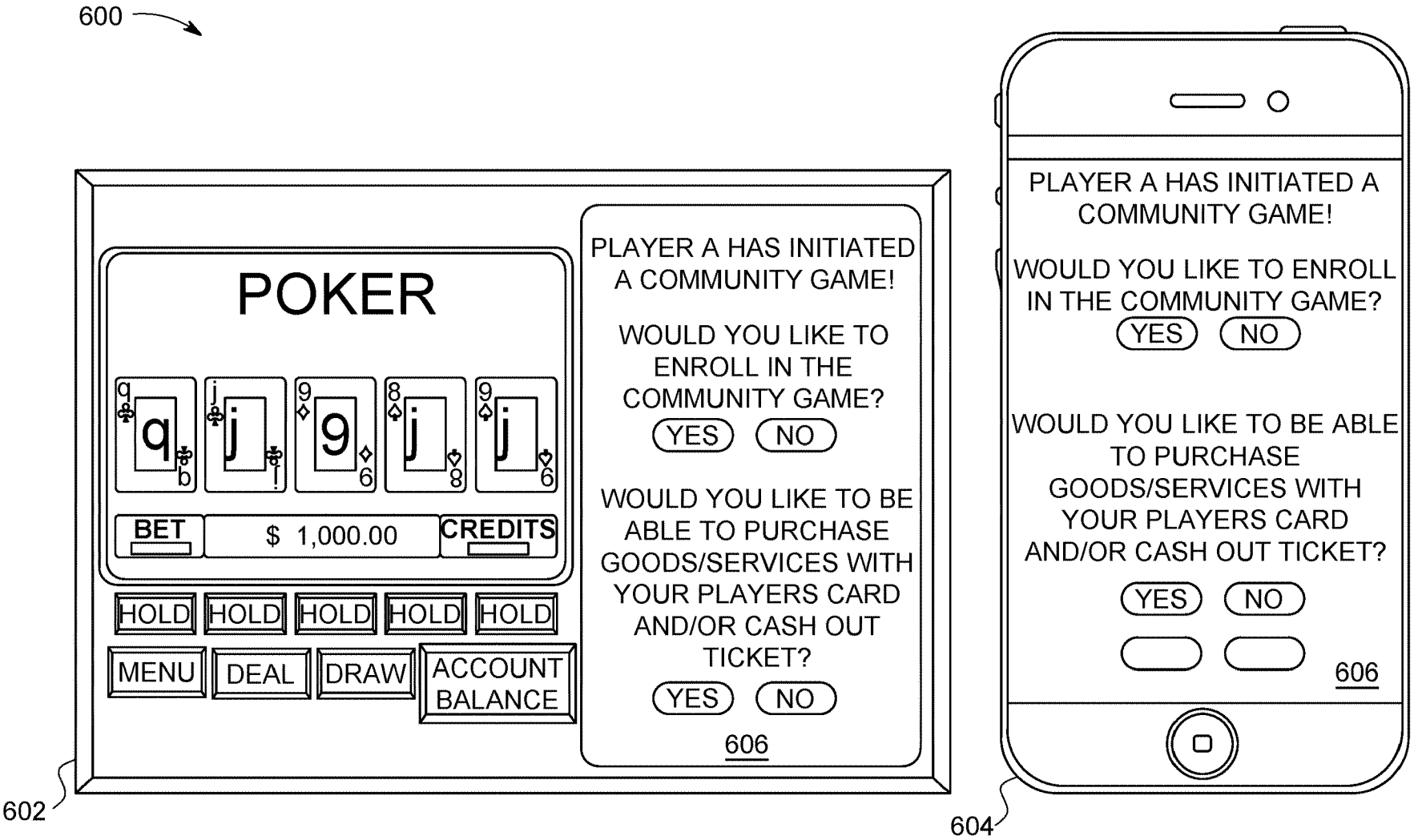
FIG. 6 is a block diagram illustrating a personal mobile device (PMD) used to enroll a player into a community game for extended gaming and services from an electronic gaming machine (EGM) for an authenticated player to the PMD.

Turning now to FIG. 6, a block diagram illustrating a gaming system 600 is depicted. The gaming system 600 includes a PMD 604 used to enroll a player into a community game for extended gaming and services from an EGM 602, for a carded player, to the PMD 604. That is, FIG. 6 displays an exemplary community gaming panel window on the PMD 604 having various EGM gaming and service options. A community gaming panel window 606 may be installed and displayed on the PMD 604 that also accesses a gaming network (see FIGS. 3-4), and an EGM 602. The EGM 602 may also display the community panel window 606 while the carded player has signed into the EGM 602.

The community gaming panel window 606 on the PMD 604 may provide opportunities for customization. For example, the player may be playing an online multiplayer game using the PMD 604, or playing in association with the EGM 602 using the PMD 604. A gaming host/server (see FIGS. 3-4) may identify a multiplayer game in the community panel window 606 and customize the PMD 604 and/or EGM 602 to match the style of the multiplayer game. Using the service window (such as service window application 508 of FIG. 5) provided in the community gaming panel window 606, various options may be displayed for the selection of one or more services such as, for example, buying drinks, ordering tickets for shows or buffets, etc. It should be noted that the community gaming panel window 606 may provide one or more gaming content, messages, menus, goods and services, and may be customized and provided to the player on the PMD 604. The community gaming panel window 606 may provide on the PMD 604 one or more social media buttons for facilitating the PMD 604 to share screen shots, gaming results, or other events/activities associated with the gaming content or goods and/or services to social media applications.

In one embodiment, a service window application (such as service window application 508 of FIG. 5) may also be displayed in the community gaming panel window 606 on the EGM 602 and/or PMD 604 showing a game/gaming content on the left side of the screen and one or more services on the right side, or vice versa. In one embodiment, the community panel window 606 (which may include the service window) may display a message relating to multiplayer gaming such as, for example, "Player A has initiated a community game! Would you like to enroll in the community game?" The community gaming panel window 606 on the EGM 602 and/or PMD 604 or the service window application provided in the community panel window 606 on the EGM 602 and/or PMD 604 may provide options for the player to select "YES" or "NO."

In one embodiment, the service window may also display additional messages in the community gaming panel window 606 on the EGM 602 and/or PMD 604, such as to ask the user "Would you like to be able to purchase goods/services with your players card and/or cash out a ticket?" The service window application may provide options for the player using the community panel window 606 on the EGM 602 and/or PMD 604 to select "YES" and/or "NO."

Figure 7:
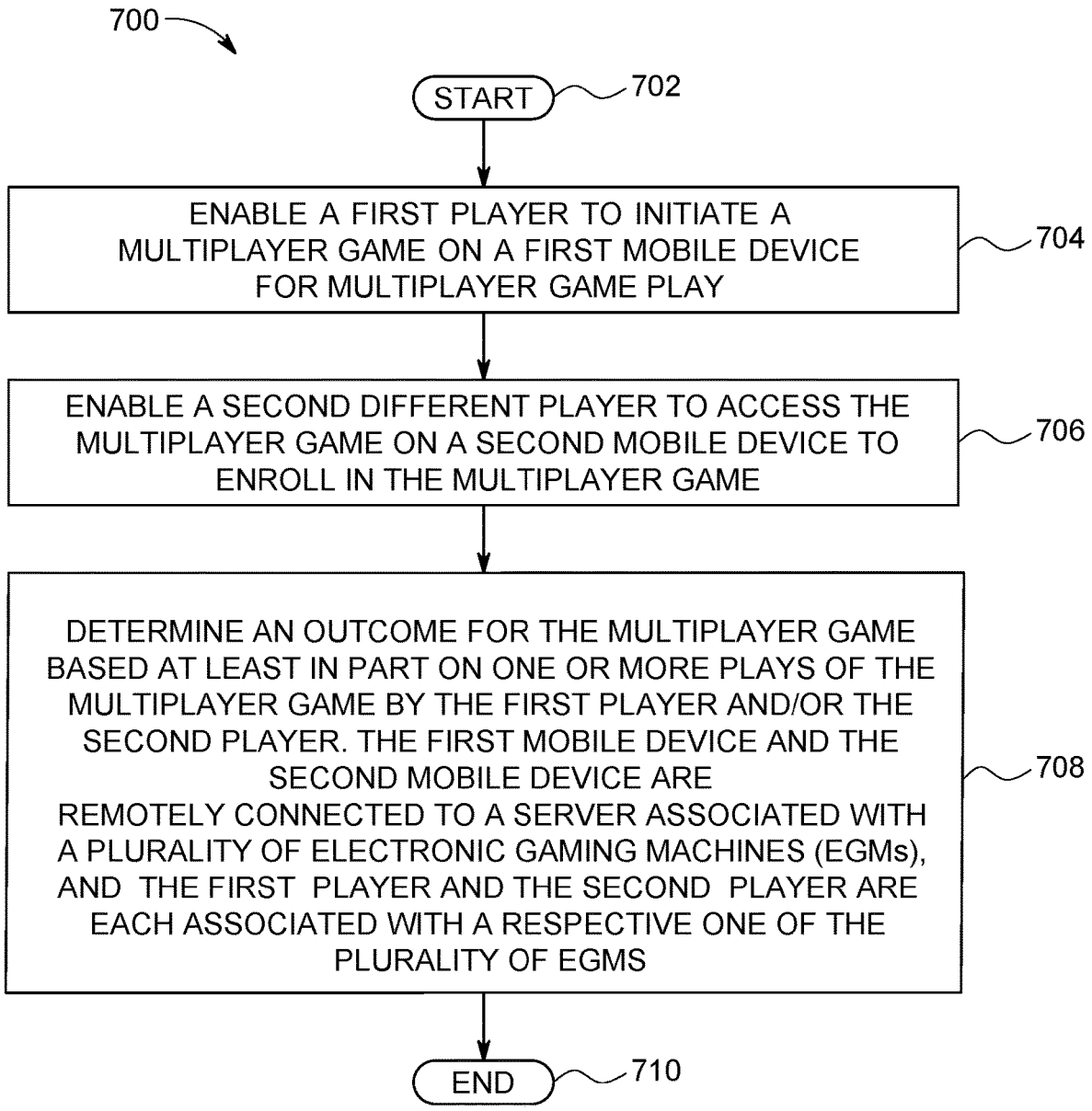
FIG. 7 is a flowchart illustrating an additional exemplary method for extending gaming and services of an authenticated player to a smartphone with a community game panel in a gaming environment.

FIG. 7 is a flowchart illustrating an exemplary method 700 for extending gaming and services of a carded player to a smartphone with a community game panel in a gaming system. That is, method 700 depicts exemplary steps/flow for extending gaming and services of a carded player to a smartphone with a community game panel in a gaming system. In this way, the method 700 transfers a community gaming panel/window onto a PMD to enable use of the PMD by a player for playing a multiplayer game associated with an EGM.

The method 700 begins in block 702. A first player (e.g., an authenticated player) may be enabled to initiate a multiplayer game on a first mobile device for multiplayer game play, as in block 704. A second player (or additional players, each of which may be authenticated) may be enabled to access the multiplayer game on a second mobile device to enroll in the multiplayer game, as in block 706. The multiplayer game may be funded by one or more wagers by the first player, the second player, a gaming venue (e.g., a casino), a third party funding source (e.g., a financial institution, an organization, a business, a governmental or quasi-governmental entity, a sporting event/music related entity, an entertainment entity, a gaming venue, an entity associated with the player, additional players, or gaming venue itself), or a combination thereof, to receive potential winnings, awards, loyalty points, prizes, rewards, services, or a combination thereof resulting from one or more game wins of the multiplayer game. An outcome may be determined for the multiplayer game based at least in part on one or more plays of the multiplayer game by the first player, the second player, or combination thereof, as in block 708. The first mobile device and the second mobile device are remotely connected to a server associated with a plurality of EGMs. The first player and the second carded player are each associated with a respective one of the plurality of EGMs. Moreover, one or more winnings, awards, loyalty points, prizes, rewards, promotions, services, or a combination thereof may be provided by, and/or to, the first player, the second carded player, one or more gaming venues, a third party (which may be an entity associated with any of the players, gaming venue(s), or other selected third party entities), or a combination thereof for the one or more game wins of the one or more plays of the multiplayer game. Further, the winnings, awards, loyalty points, prizes, rewards, promotions, or services may be defined and/or received by the players, the gaming venue, a third party, or a combination thereof. The method 700 ends in block 710.

In one aspect, in conjunction with and/or as part of at least one block of FIG. 7, the operations of functionality 700 may include each of the following. In one aspect, the method 700 may include enrolling the first carded player in the multiplayer game via the first mobile device, wherein the multiplayer game on the first mobile device is provided by one of the plurality of EGMs associated with the first carded player. The second carded player may be enrolled in the multiplayer game via the second mobile device, wherein the multiplayer game on the second mobile device is provided by one of the plurality of EGMs associated with the second carded player. The multiplayer game may be provided on the first mobile device, via the server, from a respective one of the plurality of EGMs associated with the first carded player. The multiplayer game may be provided on the second mobile device, via the server, from a respective one of the plurality of EGMs associated with the second carded player.

In one aspect, the method 700 may provide one or more services or promotions via the multiplayer game on the first mobile device and the second mobile device, wherein the first mobile device and the second mobile device enable the first carded player and the second carded player to select the one or more services or promotions. In an additional aspect, the method 700 may collect and manage data of the multiplayer game, and/or provide updates relating to the multiplayer game to the first mobile device and the second mobile device via a data network. The data network may be the Internet.

Figure 8:
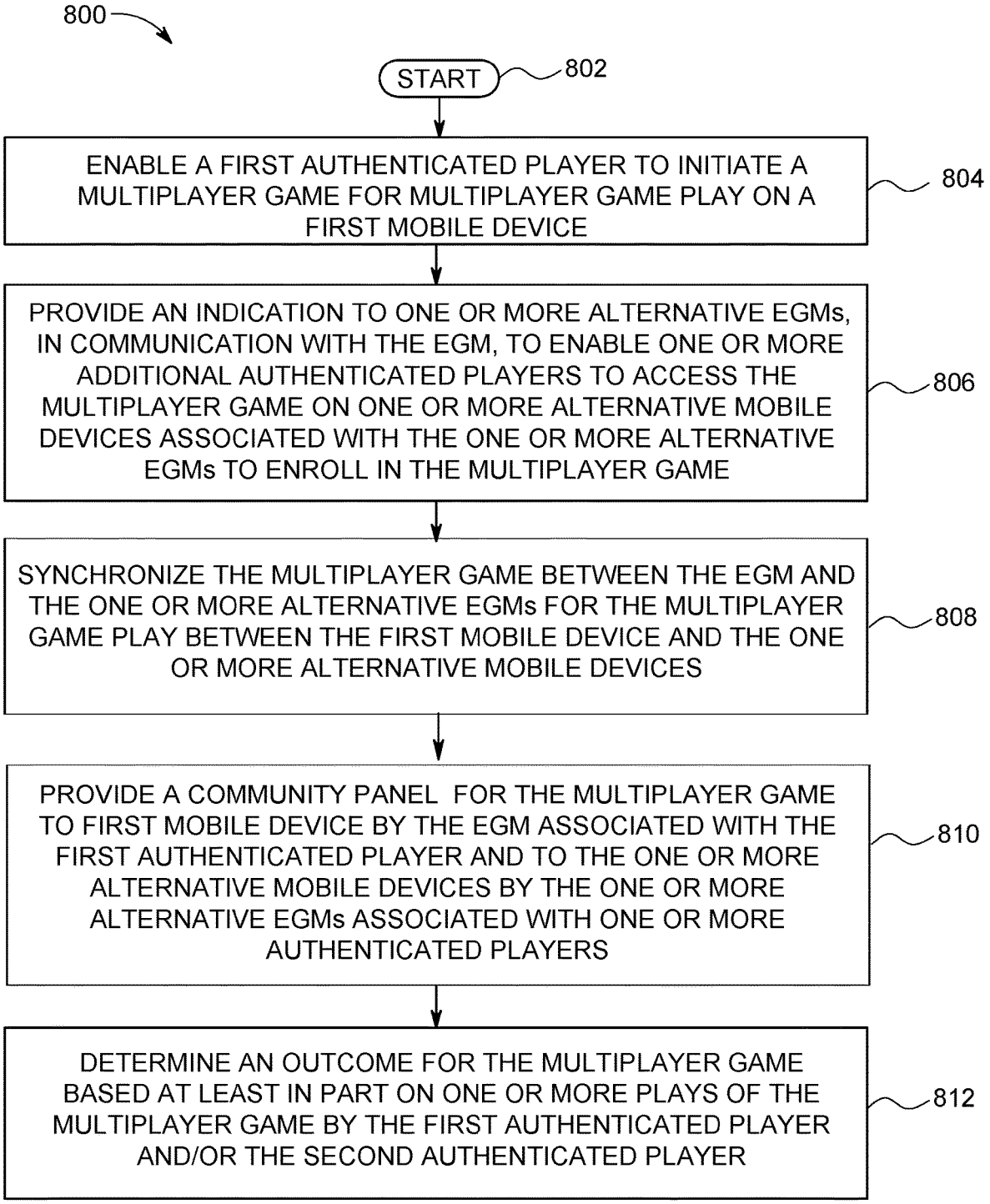
FIG. 8 is a flowchart illustrating an additional exemplary method for extending gaming and services of an authenticated player to a smartphone with a community game panel in a gaming environment.

FIG. 8 is a flowchart illustrating an additional exemplary method 800 for extending gaming and services of a carded player to a smartphone with a community game panel in a gaming environment. The method 800 begins in block 802. A first authenticated player may be enabled to initiate a multiplayer game on a first mobile device in association with an EGM for multiplayer game play, as in block 804. An indication may be provided to one or more alternative EGMs, in communication with the EGM, to enable one or more additional authenticated players (e.g., carded players) to access the multiplayer game on one or more alternative mobile devices associated with the one or more alternative EGMs to enroll in the multiplayer game, as in block 806. The multiplayer game may be synchronized between the EGM and the one or more alternative EGMs for the multiplayer game play between the first mobile device and the one or more alternative mobile devices, as in block 808. The multiplayer game on the first mobile device may be provided by the EGM associated with the first authenticated player and the multiplayer game on the one or more alternative mobile devices may be provided by the one or more alternative EGMs associated with the one or more additional authenticated players (e.g., additional carded players), as in block 810. The first mobile device may be remotely connected to the EGM and the one or more alternative mobile devices may be associated with the one or more alternative EGMs in communication with the EGM. The first authenticated player (e.g., first carded player) may be associated with the EGM and the one or more additional authenticated players (e.g., additional carded players) may each be associated with a respective one of the one or more alternative EGMs. An outcome for the multiplayer game is determined based at least in part on one or more plays of the multiplayer game by the first player, the one or more additional authenticated players (e.g., additional carded players), or combination thereof, as in block 812.

In one aspect, in conjunction with and/or as part of at least one block of FIG. 8, the operations of the method 800 may include each of the following. In one aspect, the method 800 may include enrolling the first carded player in the multiplayer game on the first mobile device, wherein the multiplayer game on the first mobile device is provided by the EGM associated with the first carded player.

In one aspect, the method 800 may synchronize the multiplayer game between the EGM and the one or more alternative EGMs for the multiplayer game play between the first mobile device and the one or more alternative mobile devices, wherein the multiplayer game on the one or more alternative mobile devices is provided by the one or more alternative EGMs associated with the one or more additional carded players.

In an additional aspect, the method 800 may provide the multiplayer game on the first mobile device via the EGM associated with the first carded player; and/or provide the multiplayer game on the one or more alternative mobile devices via the one or more alternative EGMs associated with the one or more additional carded players. One or more services or promotions may be provided via the multiplayer game, wherein the first mobile device and the one or more alternative mobile devices enable the first carded player and the one or more additional carded players to select the one or more services or promotions. The method 800 may also include collecting and managing data of the multiplayer game, and/or provide updates relating to the multiplayer game to the first mobile device and the one or more additional carded players via a data network.

In one aspect, a player may enable one or more computer players (virtual players) in the community panel, which may assist the multiplayer game if, for example, the game is a 4 player game and only 3 human players are available. Also, enabling the one or more computer players may be useful in a case that a player does not want to play against any humans. The computer player may have to contribute to the pool such as, for example, by providing a credit or wager and the credit or wager may be funded from a gaming venue (e.g., a casino).

In an additional aspect, multiplayer games may have "mini-goals" that award the player before a final goal is reached. For example, instead of "winner-takes-all", a player may receive an award for being first to a 25% competition mark. The mini-goals may be part of a game storyline to make the multiplayer game even more exciting for the player.

As an additional aspect, because tracking cards of each of the multiplayer game players may be in use, each multiplayer game player may receive fractionalized player points from an originating multiplayer game as it is played by the originating community panel player. This causes a large incentive for players to want to join as many community games as possible.

In one aspect, each player may simultaneously enroll in multiple multiplayer games.

Also, multiple players may enroll in one or more multiplayer games on a single EGM. For example, in a bar and tavern venue, a multiplayer game such as, for example, the aforementioned "Keno Racer" may be played by multiple players (e.g., four players) on a single Keno EGM. Each player may insert the player's tracking card during the enrollment process.

In an additional embodiment, one or more multiplayer games may not require a player tracking card. Instead, a player may enroll on the originating community panel player's EGM by entering in a unique name for the enrolling player, enrolling, and wagering a bet to play the multiplayer game on the originating community panel player's EGM. If this newly enrolled player wins, a cash out may occur on the originating community panel player's EGM. Moreover, the originating community panel player's EGM may be enabled to require the winning player (e.g., the newly enrolled player that won the multiplayer game on the originating community panel player's EGM) to be responsible for claiming their prize.

Additionally, a player may enroll at any community panel enabled EGM. If the player wins the multiplayer game, a payout may occur at the originating multiplayer game EGM rather than at the EGM the new community panel player enrolled on.

Players may also enroll in multiplayer games in a hybrid fashion. For example, one or more players may enter the multiplayer game without a player tracking card and other players may enter the multiplayer game with a tracking card. That is, one or more means and methods may be used for players to enroll in a multiplayer game, which may be referred to as hybrid enrollment.

In an additional aspect, players may choose to receive the player's payout at a kiosk or at the cashier instead of at an EGM. Players may be tracked using a player's card. For those players that played without a tracking card, the player may redeem the player's winnings using a PIN number that they entered at a multiplayer game enrollment at the kiosk or cashier. Requiring the same multiplayer game enrollment PIN at the kiosk or cashier protects against the winning community panel player from theft of credits, winnings, awards, or prizes.

The multiplayer game panel and functionality may be employed within a service window application.

As will be appreciated by one skilled in the art, aspects of the present disclosure may be embodied as an apparatus, system, method or a computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system."

Aspects of the present disclosure have been described above with reference to flowchart illustrations and/or block diagrams of methods, apparatus, and systems according to embodiments of the disclosure. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks.

These computer program instructions may also be stored in a computer readable storage medium that may direct a computer, other programmable data processing apparatus, or other devices to function in a particular manner, such that the instructions stored in the computer readable storage medium produce an article of manufacture including instructions which implement the function/act specified in the flowcharts and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowcharts and/or block diagram block or blocks.

A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

The flowcharts and block diagrams in the above figures illustrate the architecture, functionality, and operation of possible implementations of systems, methods and computer program products according to various embodiments of the present disclosure. In this regard, each block in the flowcharts or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. A method of operating a gaming system, by at least one processor, comprising:

enabling a first authenticated player to initiate, on a first mobile device, a multiplayer game via a community gaming panel for multiplayer game play;

determining a minimum bet set by the first authenticated player for the multiplayer game;

determining a wager pool amount for the multiplayer game based on the minimum bet set by the first authenticated player and a number of additional authenticated players that are enrolled in the multiplayer game;

receiving, from the first mobile device, multiplayer game attribute selections provided by the first authenticated player;

creating the multiplayer game based at least in part on the multiplayer game attribute selections, the minimum bet, and the wager pool amount;

enabling additional authenticated players to access the multiplayer game on additional mobile devices to enroll in the multiplayer game, wherein access to the multiplayer game is enabled through the community gaming panel that is associated with a service window application, and wherein the multiplayer game is funded by wagers placed by the first authenticated player and the additional authenticated players; and determining an outcome for the multiplayer game based at least in part on plays of the multiplayer game by the first authenticated player and the additional authenticated players, wherein the first mobile device and the additional mobile devices are remotely connected to a server associated with a plurality of electronic gaming machines (EGMs) in a casino, wherein the outcome comprises a distribution of the wager pool amount, wherein the first authenticated player and the additional authenticated players are each associated with a respective one of the plurality of EGMs, and wherein the community gaming panel is provided to the first authenticated player by a first EGM from the plurality of EGMs.

2. The method of claim 1, further comprising enrolling, by the first authenticated player, in the multiplayer game via the first mobile device through the community gaming panel; wherein the community gaming panel is displayed on the first mobile device as a separate overlay atop a primary game played by the first authenticated player.

3. The method of claim 2, further comprising enrolling, by the additional authenticated players, in the multiplayer game via the additional mobile devices through the community gaming panel displayed on each of the additional mobile devices, wherein the additional authenticated players are selected from a list comprising human players and computer players.

4. The method of claim 1, further comprising providing the multiplayer game for display on the first mobile device, via the server, from the respective one of the plurality of EGMs associated with the first authenticated player.

5. The method of claim 1, further comprising providing the multiplayer game the additional mobile devices, via the server, from the respective one of the plurality of EGMs associated with the additional authenticated players.

6. The method of claim 1, further comprising providing selections for services or promotions within the community gaming panel on the first mobile device and the additional mobile devices, wherein the first mobile device and the additional mobile devices enable the first authenticated player and the additional authenticated players to select the services or promotions during game play of the multiplayer game.

7. The method of claim 1, further comprising:

collecting and managing data of the multiplayer game by respective ones of the plurality of EGMs via the server; and providing updates relating to the multiplayer game to the first mobile device and the additional mobile devices via a data network.

8. The method of claim 1, further comprising, according to the outcome of the multiplayer game, providing through the community gaming panel displayed on the first mobile device and the additional mobile devices, selected from a list comprising winnings, awards, loyalty points, prizes, and services for game wins of plays of the multiplayer game.

9. A gaming system comprising:

a data network;

a first mobile device;

a second mobile device;

a plurality of electronic gaming machines (EGMs);

a server having a server processor; and server memory that stores executable instructions which, when executed by the server processor, cause the server processor to:

enable a first authenticated player to initiate, on the first mobile device, a multiplayer game via a community gaming panel for multiplayer game play;

determine a minimum bet selected by the first authenticated player for the multiplayer game;

determine a wager pool amount for the multiplayer game based on the minimum bet selected by the first authenticated player and a number of additional authenticated players that are enrolled in the multiplayer game;

receive, from the first mobile device, multiplayer game attribute selections provided by the first authenticated player;

create the multiplayer game based at least in part on the multiplayer game attribute selections, the minimum bet, and the wager pool amount;

enable additional authenticated players to access the multiplayer game on additional mobile devices to enroll in the multiplayer game, wherein access to the multiplayer game is enabled through the community gaming panel that is associated with a service window application, and wherein the multiplayer game is funded by wagers placed by the first authenticated player and the additional authenticated players; and determine an outcome for the multiplayer game based at least in part on plays of the multiplayer game by the first player and the additional authenticated players, wherein the first mobile device and the additional mobile devices are remotely connected to the server associated with the plurality of electronic gaming machines (EGMs), wherein the outcome comprises a distribution of the wager pool amount, wherein the first authenticated player and the additional authenticated players are each associated with a respective one of the plurality of EGMs, and wherein the community gaming panel is provided to the first authenticated player by a first EGM from the plurality of EGMs.

10. The gaming system of claim 9, wherein the executable instructions cause the server processor to enroll the first authenticated player in the multiplayer game via the first mobile device through the community gaming panel; wherein the community gaming panel is displayed on the first mobile device as a separate overlay atop a primary game played by the first authenticated player.

11. The gaming system of claim 10, wherein the executable instructions cause the server processor to enroll the additional authenticated players in the multiplayer game via the additional mobile devices through the community gaming panel displayed on each of the additional mobile devices, wherein the additional authenticated players are selected from a list comprising human players and computer players.

12. The gaming system of claim 9, wherein the executable instructions cause the server processor to provide the multiplayer game for display on the first mobile device, via the server, from the respective one of the plurality of EGMs associated with the first authenticated player.

13. The gaming system of claim 9, wherein the executable instructions cause the server processor to provide the multiplayer game for display on the additional mobile devices, via the server, from the respective one of the plurality of EGMs associated with the additional authenticated players.

14. The gaming system of claim 9, wherein the executable instructions cause the server processor to provide selections for services or promotions within the community gaming panel on the first mobile device and the additional mobile devices, wherein the first mobile device and the additional mobile devices enable the first authenticated player and the additional authenticated players to select the services or promotions during game play of the multiplayer game.

15. The gaming system of claim 9, wherein the executable instructions cause the server processor to:

collect and manage data of the multiplayer game by respective ones of the plurality of EGMs via the server; and provide updates relating to the multiplayer game to the first mobile device and the additional mobile devices via the data network.

16. The gaming system of claim 9, wherein the executable instructions cause the server processor to, according to the outcome of the multiplayer game, provide through the community gaming panel displayed on the first mobile device and the additional mobile devices, selected from a list comprising winnings, awards, loyalty points, prizes, and services for game wins of plays of the multiplayer game.

17. An electronic gaming machine (EGM), comprising:

a display;

a communication module;

a memory device; and a processor executing instructions stored in the memory device, wherein the instructions, when executed, cause the processor to:

enable a first authenticated player to initiate, on a first mobile device in communication with the EGM, a multiplayer game via a community gaming panel for multiplayer game play, wherein the community gaming panel is provided to the first authenticated player by the processor;

determine a minimum bet selected by the first authenticated player for the multiplayer game;

determine a wager pool amount for the multiplayer game based on the minimum bet selected by the first authenticated player and a number of additional authenticated players that are enrolled in the multiplayer game;

receive, from the first mobile device, multiplayer game attribute selections provided by the first authenticated player;

create the multiplayer game based at least in part on the multiplayer game attribute selections, the minimum bet, and the wager pool amount;

provide an indication to alternative EGMs in communication with the EGM, to enable additional authenticated players to access the multiplayer game on additional mobile devices to enroll in the multiplayer game, wherein each of the additional mobile devices is associated with a respective one of the alternative EGMs, and the multiplayer game is funded by wagers placed by the first authenticated player and the additional authenticated players; and determine an outcome for the multiplayer game based at least in part on plays of the multiplayer game by the first authenticated player and the additional authenticated players, wherein the outcome comprises a distribution of the wager pool amount, the first mobile device and the additional mobile devices are remotely connected to a server associated with the EGM and the alternative EGMs.

18. The EGM of claim 17, wherein the instructions, when executed, cause the processor to enroll the first authenticated player in the multiplayer game via the first mobile device through the community gaming panel; wherein the community gaming panel is displayed on the first mobile device as a separate overlay atop a primary game played by the first authenticated player.

19. The EGM of claim 17, wherein the instructions, when executed, cause the processor to synchronize the multiplayer game between the EGM and the alternative EGMs for the multiplayer game play between the first mobile device and the additional mobile devices.

20. The EGM of claim 17, wherein the instructions, when executed, cause the processor to:

provide the multiplayer game for display on the first mobile device via the EGM associated with the first authenticated player; and provide the multiplayer game for display on the additional mobile devices via the alternative EGMs, each associated with the additional authenticated players.

21. The EGM of claim 17, wherein the instructions, when executed, cause the processor to provide selections for services within the community gaming panel on the first mobile device and the additional mobile devices, wherein the first mobile device and the additional mobile devices enable the first authenticated player and the additional authenticated players to select the services during game play of the multiplayer game.

22. The EGM of claim 17, wherein the instructions, when executed, cause the processor to:

collect and manage data of the multiplayer game through the server associated with the EGM; and provide updates relating to the multiplayer game to the first mobile device and the additional mobile devices via a data network.

23. The EGM of claim 17, wherein the instructions, when executed, cause the processor to, according to the outcome of the multiplayer game, provide through the community gaming panel displayed on the first mobile device and the additional mobile devices, selected from a list comprising winnings, awards, loyalty points, prizes, and services for game wins of plays of the multiplayer game.

* * * * *